US008278893B2

(12) United States Patent
Motz

(10) Patent No.: US 8,278,893 B2
(45) Date of Patent: Oct. 2, 2012

(54) SYSTEM INCLUDING AN OFFSET VOLTAGE ADJUSTED TO COMPENSATE FOR VARIATIONS IN A TRANSISTOR

(75) Inventor: Mario Motz, Wernberg (AT)

(73) Assignee: Infineon Technologies AG, Neubiberg (DE)

( * ) Notice: Subject to any disclaimer, the term of this patent is extended or adjusted under 35 U.S.C. 154(b) by 738 days.

(21) Appl. No.: 12/174,261

(22) Filed: Jul. 16, 2008

(65) Prior Publication Data

US 2010/0013448 A1 Jan. 21, 2010

(51) Int. Cl.
*G05F 1/00* (2006.01)

(52) U.S. Cl. ..... 323/273; 323/311; 323/312; 327/535; 327/538; 327/540

(58) Field of Classification Search ..... 323/65, 323/68, 69, 74, 76, 223, 271, 272, 273, 311, 323/312, 314, 315; 327/530, 535, 538, 539, 327/540, 541
See application file for complete search history.

(56) References Cited

U.S. PATENT DOCUMENTS

| | | | | |
|---|---|---|---|---|
| 5,036,269 | A | 7/1991 | Murari et al. | |
| 6,040,736 | A | 3/2000 | Milanesi et al. | |
| 6,188,212 | B1 | 2/2001 | Larson et al. | |
| 6,259,316 | B1 | 7/2001 | Nagaraj | |
| 6,285,246 | B1 | 9/2001 | Basu | |
| 6,677,735 | B2 | 1/2004 | Xi | |
| 6,690,147 | B2 | 2/2004 | Bonto | |
| 6,696,822 | B2 * | 2/2004 | Takabayashi | 323/224 |
| 6,703,813 | B1 | 3/2004 | Vladislav et al. | |
| 6,703,815 | B2 | 3/2004 | Biagi | |
| 6,703,816 | B2 | 3/2004 | Biagi et al. | |
| 6,707,280 | B1 * | 3/2004 | Liu et al. | 323/224 |
| 6,975,099 | B2 * | 12/2005 | Wu et al. | 323/280 |
| 6,977,490 | B1 | 12/2005 | Zhang et al. | |
| 6,989,659 | B2 | 1/2006 | Menegoli et al. | |
| 7,030,677 | B2 | 4/2006 | Pannwitz | |
| 7,038,431 | B2 * | 5/2006 | Benbrik | 323/273 |
| 7,081,742 | B2 * | 7/2006 | Ito et al. | 323/273 |

(Continued)

FOREIGN PATENT DOCUMENTS

DE 68909577 T2 6/1994

OTHER PUBLICATIONS

"A 5mA .6um CMOS Miller-Compensated LDO Regulator with -27dB Worst-Case Power-Supply Rejection Using 60pF of On-Chip Capacitance", Vishal Gupta, et al., ISSCC, Analog and Power Management Techniques, 2006 (2 pgs.).

(Continued)

*Primary Examiner* — Nguyen Tran
(74) *Attorney, Agent, or Firm* — Dicke, Billig & Czaja, PLLC

(57) ABSTRACT

A system including a first transistor, a first capacitor and a circuit. The first transistor has a first control input and is configured to regulate an output voltage. The first capacitor is coupled at one end to the first control input and at another end to a circuit reference. The circuit is configured to provide a first voltage to the first control input, where the first voltage includes an offset voltage that is referenced to the output voltage and adjusted to compensate for variations in the first transistor.

22 Claims, 20 Drawing Sheets

U.S. PATENT DOCUMENTS

| | | | | |
|---|---|---|---|---|
| 7,402,985 | B2 * | 7/2008 | Zlatkovic | 323/275 |
| 7,554,304 | B2 * | 6/2009 | Kruiskamp et al. | 323/272 |
| 2004/0046532 | A1 * | 3/2004 | Menegoli et al. | 323/273 |
| 2007/0075692 | A1 | 4/2007 | Ostrom et al. | |
| 2007/0159155 | A1 * | 7/2007 | Itoh | 323/316 |
| 2008/0157735 | A1 | 7/2008 | Liu et al. | |

OTHER PUBLICATIONS

"A 500 MHz Supply Noise Insensitive CMOS PLL with A Voltage Regulator Using DC-DC Capacitive Converter", Chang Hyeon Lee, et al., Wireless Communications Division (4 pgs.).

"A Fully Integrated Low EMI Noise Power Supply Technique for CMOS Digital IC's in Automotive Applications", Junfeng Zhou, IEEE, 2007 (4 pgs.).

"A Low Dropout, CMOS Regulator with High PSR over Wideband Frequencies", Vishal Gupta, IEEE, 2005 (4 pgs.).

"A Supply-Noise-Insensitive CMOS PLL with a Voltage Regulator Using DC-DC Capacitive Converter", Chang-Hyeon Lee, IEEE, 2001 (11 pgs.).

"NMOS Low Drop-Out Regulator with Dynamic Biasing", Gianluca Giustolisi, et al., IEEE, 2006 (4 pgs.).

* cited by examiner

SYSTEM INCLUDING AN OFFSET VOLTAGE ADJUSTED TO COMPENSATE FOR VARIATIONS IN A TRANSISTOR

BACKGROUND

Low drop-out (LDO) voltage regulators are linear voltage regulators that operate with a small power supply to output voltage drop. LDO regulators provide a DC output voltage via a pass transistor situated between the power supply and the output. The drop-out voltage is related to output current via the on resistance of the pass transistor. Typically, the pass transistor is a PMOS transistor that does not require its gate voltage to be driven high and the drop-out voltage is limited by the on resistance of the PMOS transistor. Alternative strategies include gate voltage pumping, which is often dismissed due to noise, power consumption and startup time constraints.

LDO regulators can be used in automotive applications, where external power supply voltages fluctuate and only small voltage drops are permitted between the external power supply voltages and the output voltages of the LDO regulator. However, the automotive environment is a noisy environment and power supply ripple is sometimes transferred to the output of the LDO regulator. Using external capacitors to reduce ripple increases costs and reduces reliability.

Some LDO regulators are coupled to digital circuitry that generates current spikes, such as switching current spikes and current spikes due to pre-loading and un-loading of capacitances. Regulators with fast load regulation respond to the current spikes, but produce electromagnetic interference (EMI) via the power supply lines. This EMI is a problem in some situations, such as in sensors using a current interface, mobile phones, and integrated circuits in automotive applications.

For these and other reasons, there is a need for the present invention.

SUMMARY

One embodiment described in the disclosure provides a system including a first transistor, a first capacitor and a circuit. The first transistor has a first control input and is configured to regulate an output voltage. The first capacitor is coupled at one end to the first control input and at another end to a circuit reference. The circuit is configured to provide a first voltage to the first control input, where the first voltage includes an offset voltage that is referenced to the output voltage and adjusted to compensate for variations in the first transistor.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

Figure 1:
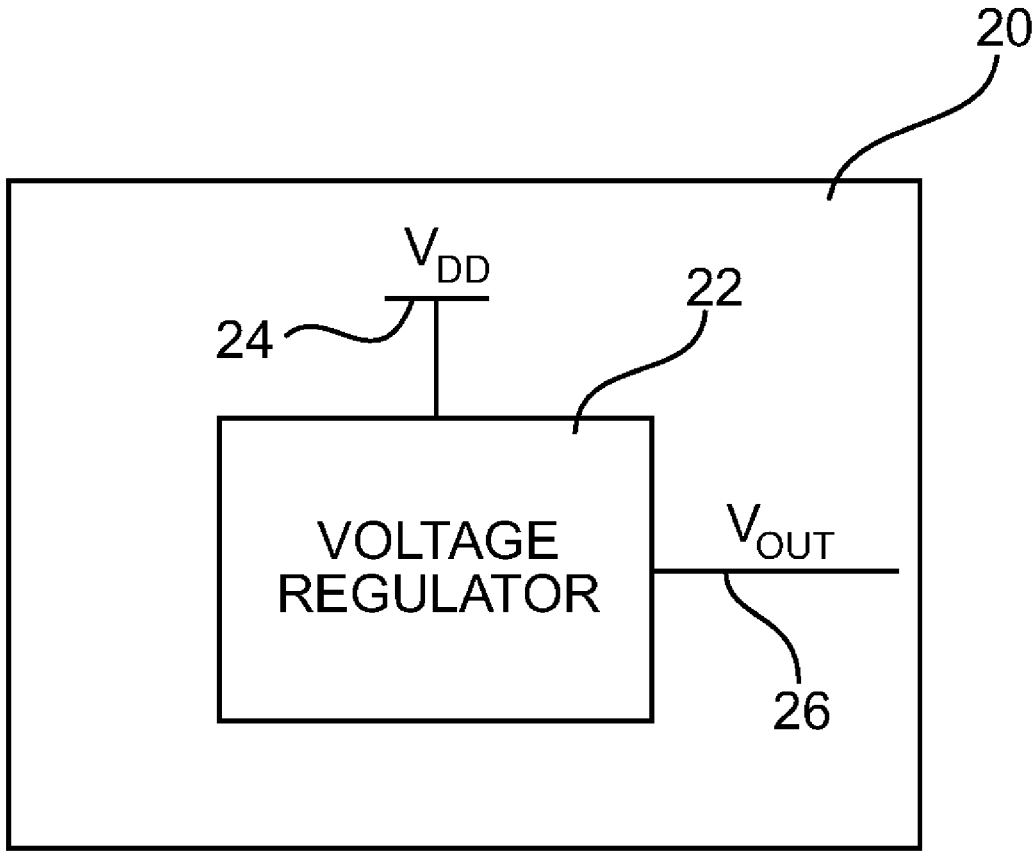
FIG. 1 is diagram illustrating one embodiment of a system including a voltage regulator.

FIG. 1 is a diagram illustrating one embodiment of a system 20 including a voltage regulator 22. In one embodiment, system 20 is an automobile system. In one embodiment, system 20 is a sensor. In one embodiment, system 20 is a mobile phone. In other embodiments, system 20 is any suitable system that uses a voltage regulator.

Voltage regulator 22 receives power supply voltage VDD at 24 and provides a regulated output voltage VOUT at 26. In one embodiment, voltage regulator 22 is a LDO voltage regulator.

Voltage regulator 22 includes an n-channel metal oxide semiconductor (NMOS) regulation transistor having a control input that receives an offset voltage. The offset voltage shifts the voltage at the control input to drive the NMOS regulation transistor. In one embodiment, the offset voltage is referenced to the regulated output voltage VOUT at 26, which reduces noise in output voltage VOUT at 26. In one embodiment, the offset voltage is adjusted to compensate for variations in the regulation transistor that may be due to changes, such as temperature changes and technology/process changes.

In one embodiment, voltage regulator 22 includes a regulation transistor and a cascode transistor coupled in series between power supply voltage VDD at 24 and output voltage VOUT at 26. Each of the transistors has a compensation capacitor coupled to its control input and the series combination of the regulation transistor and the cascode transistor improves power supply ripple rejection (PSRR). Also, each of the transistors can be controlled to provide a small voltage drop, such that if power supply voltage VDD at 24 drops to a low voltage value, voltage regulator 22 maintains the regulated output voltage VOUT at 26. In one embodiment, the regulation transistor is a low voltage NMOS transistor configured to be a source follower and the cascode transistor is a high voltage NMOS transistor.

In one embodiment, the cascode transistor receives a drive voltage referenced to output voltage VOUT at 26. In one embodiment, the cascode transistor receives a drive voltage adjusted to compensate for variations in the cascode transistor that may be due to changes, such as temperature changes and technology/process changes.

In one embodiment, voltage regulator 22 provides current to compensate for current spiking in the output VOUT at 26. Voltage regulator 22 includes a current damping device that charges a tank capacitor coupled to the regulation transistor. Current is provided to the output VOUT at 26 by discharging the tank capacitor through the regulation transistor. This reduces current spiking in the output VOUT at 26 and in the power supply lines, such that EMI is reduced. Voltage regulator 22 responds with fast load regulation and reduces EMI due to current spikes.

In one embodiment, voltage regulator 22 includes a damping device and an overload circuit to shunt excess damping device current away from the capacitor. In one embodiment, voltage regulator 22 includes a damping device and an underload circuit to shunt current around the damping device and to the regulation transistor.

Figure 2:
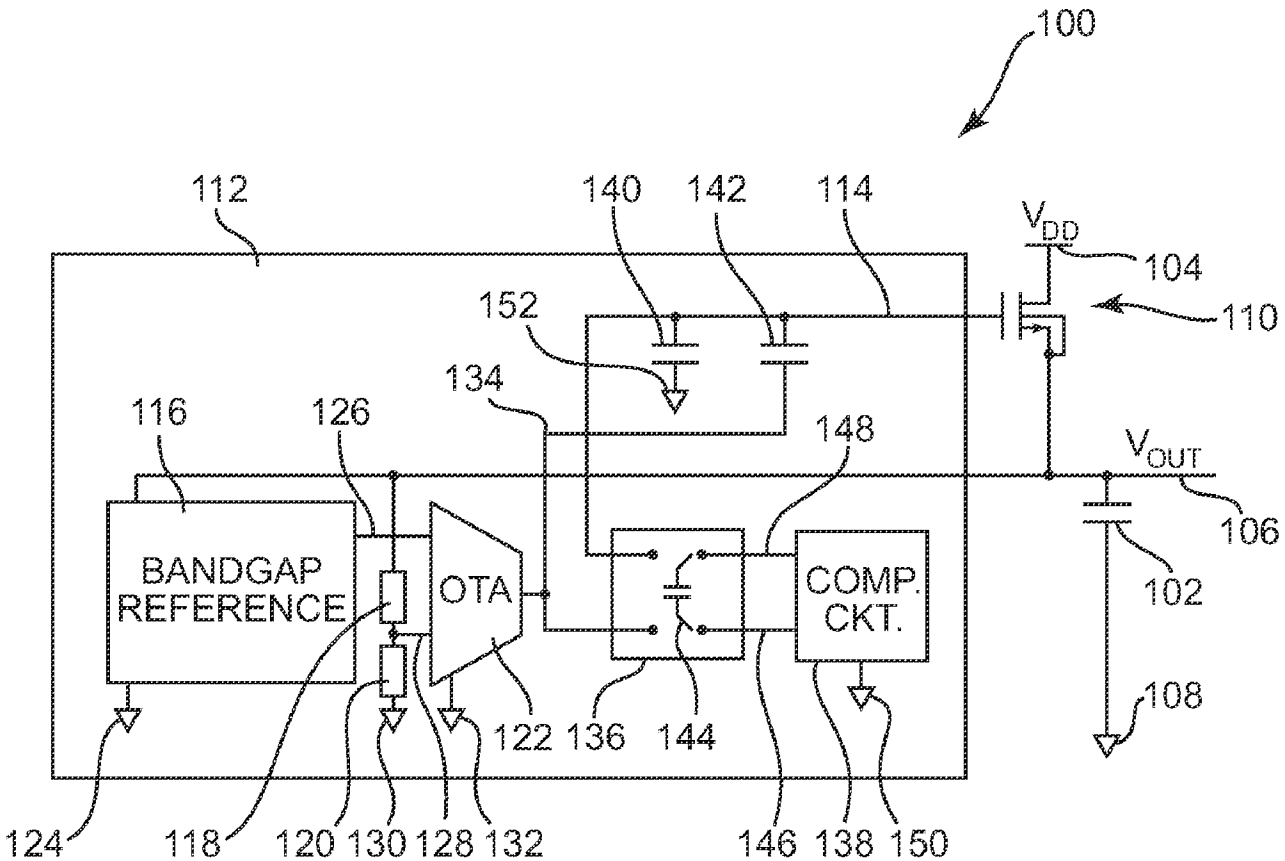
FIG. 2 is diagram illustrating one embodiment of a LDO voltage regulator coupled to a load capacitance.

FIG. 2 is a diagram illustrating one embodiment of a LDO voltage regulator 100 coupled to a load capacitance 102. LDO voltage regulator 100 receives power supply voltage VDD at 104 and provides regulated output voltage VOUT at 106. One end of load capacitance 102 is electrically coupled to the output of LDO voltage regulator 100 via output line 106 and the other end of load capacitance 102 is electrically coupled to a circuit reference, such as ground, at 108. Load capacitance 102 is substantially determined by the connected load. LDO voltage regulator 100 is similar to voltage regulator 22 (shown in FIG. 1).

LDO voltage regulator 100 includes a regulation transistor 110 and a low voltage driver 112. Regulation transistor 110 is an NMOS transistor in a source follower configuration. The drain of regulation transistor 110 is electrically coupled to power supply voltage VDD at 104 and the body and source of regulation transistor 110 are electrically coupled to load capacitance 102 via output line 106. Low voltage driver 112 is electrically coupled to the gate of regulation transistor 110 via control input path 114 and to the output of LDO voltage regulator 100 via output line 106. The gate of regulation transistor 110 is a control input driven by low voltage driver 112.

Low voltage driver 112 receives regulated output voltage VOUT at 106 and provides a driver voltage to the gate of regulation transistor 110 via control input path 114. To provide the driver voltage to the gate of regulation transistor 110, low voltage driver 112 includes a control loop referenced to output voltage VOUT at 106.

Low voltage driver 112 includes a bandgap reference 116, a resistor divide network including top resistor 118 and bottom resistor 120, and an operational transconductance amplifier (OTA) 122. Bandgap reference 116 is electrically coupled to the output of LDO voltage regulator 100 via output line 106 and to a circuit reference, such as ground, at 124. Bandgap reference 116 is also electrically coupled to one input of OTA 122 via reference input path 126. One end of top resistor 118 is electrically coupled to the output of LDO voltage regulator 100 via output line 106 and the other end of top resistor 118 is electrically coupled to one end of bottom resistor 120 and the other input of OTA 122 via feedback input path 128. The other end of bottom resistor 118 is electrically coupled to a circuit reference, such as ground, at 130. OTA 122 is electrically coupled to the output of LDO voltage regulator 100 via output line 106 and to a circuit reference, such as ground, at 132.

Bandgap reference 116 provides a reference voltage to the one input of OTA 122 via reference input path 126 and the resistor divide network, including resistors 116 and 118, provides a feedback voltage to the other input of OTA 122 via feedback input path 128. The resistor divide network, including resistors 116 and 118, receives output voltage VOUT at 106 and provides a fraction of output voltage VOUT at 106 as the feedback voltage at 128. The feedback voltage corresponds to output voltage VOUT at 106. OTA 122 receives the reference voltage and the feedback voltage and provides a control voltage on OTA output path 134. The control voltage corresponds to the difference between the reference voltage and the feedback voltage.

Low voltage driver 112 also includes a switching circuit 136, a compensation circuit 138, a compensation capacitor 140 and a driver capacitor 142. Switching circuit 136 is substantially represented via switched capacitor 144 and includes two output paths and two input paths. One output path is electrically coupled to the output of OTA 122 via OTA output path 134 and the other output path is electrically coupled to the gate of regulation transistor 108 via control input path 114. One input path is electrically coupled to one output of compensation circuit 138 via compensation output path 146 and the other input path is electrically coupled to another output of compensation circuit 138 via compensation output path 148. Compensation circuit 138 is electrically coupled to the output of LDO voltage regulator 100 via output line 106 and to a circuit reference, such as ground, at 150.

Compensation capacitor 140 is electrically coupled at one end to the gate of regulation transistor 110 via control input path 114 and to a circuit reference, such as ground, at 152. Driver capacitor 142 is electrically coupled at one end to the gate of regulation transistor 110 via control input path 114 and at the other end to the output of OTA 124 via OTA output path 134.

Compensation circuit 138 provides an offset voltage across compensation output paths 146 and 148, which is switched onto switched capacitor 144. In one embodiment, compensation circuit 138 is referenced to output voltage VOUT at 106 and not to the circuit reference, such as ground, at 150. In one embodiment, compensation circuit 138 provides an offset voltage that is adjusted to compensate for variations in regulation transistor 110. In one embodiment, compensation circuit 138 is referenced to output voltage VOUT at 106 and not to the circuit reference, such as ground, at 150 and compensation circuit 138 provides an offset voltage that is adjusted to compensate for variations in regulation transistor 110. In one embodiment, compensation circuit 138 includes a transistor that is similar to regulation transistor 110, such that the offset voltage is adjusted to compensate for variations in regulation transistor 110. In one embodiment, compensation circuit 138 is a resistor that compensates for a threshold voltage Vt plus a saturation voltage Vdsat of regulation transistor 110. In one embodiment, compensation circuit 138 adjusts the offset voltage to compensate for variations in regulation transistor 110, such as temperature and process changes.

Switching circuit 136 receives the offset voltage from compensation circuit 138 and switches the offset voltage onto switched capacitor 144. Switching circuit 136 provides the offset voltage from switched capacitor 144 to driver capacitor 142, such that driver capacitor 142 operates similar to a battery. In one embodiment, switching circuit 136 operates at greater than 100 kHz. In one embodiment, switching circuit 136 operates at greater than 1 MHz.

In operation, OTA 122 provides a control voltage at 134 that corresponds to the difference between the reference voltage and the feedback voltage, where the feedback voltage corresponds to the output voltage VOUT at 106. The offset voltage across driver capacitor 142 is added to the control voltage at 134 to provide a driving voltage on control input path 114. This driving voltage at 114 drives and controls regulation transistor 110 to regulate output voltage 106. Compensation capacitor 140 stabilizes output voltage VOUT at 106 and contributes to providing ripple rejection. The maximum PSRR is limited by the relationship of: the drain to gate capacitance of regulation transistor 110 divided by the capacitance of compensation capacitor 140. In one embodiment, PSRR is about −30 dB. In one embodiment, the voltage drop across regulation transistor 110 can be reduced to less than 0.2 volts to provide a LDO regulated output voltage VOUT at 106.

Figure 3:
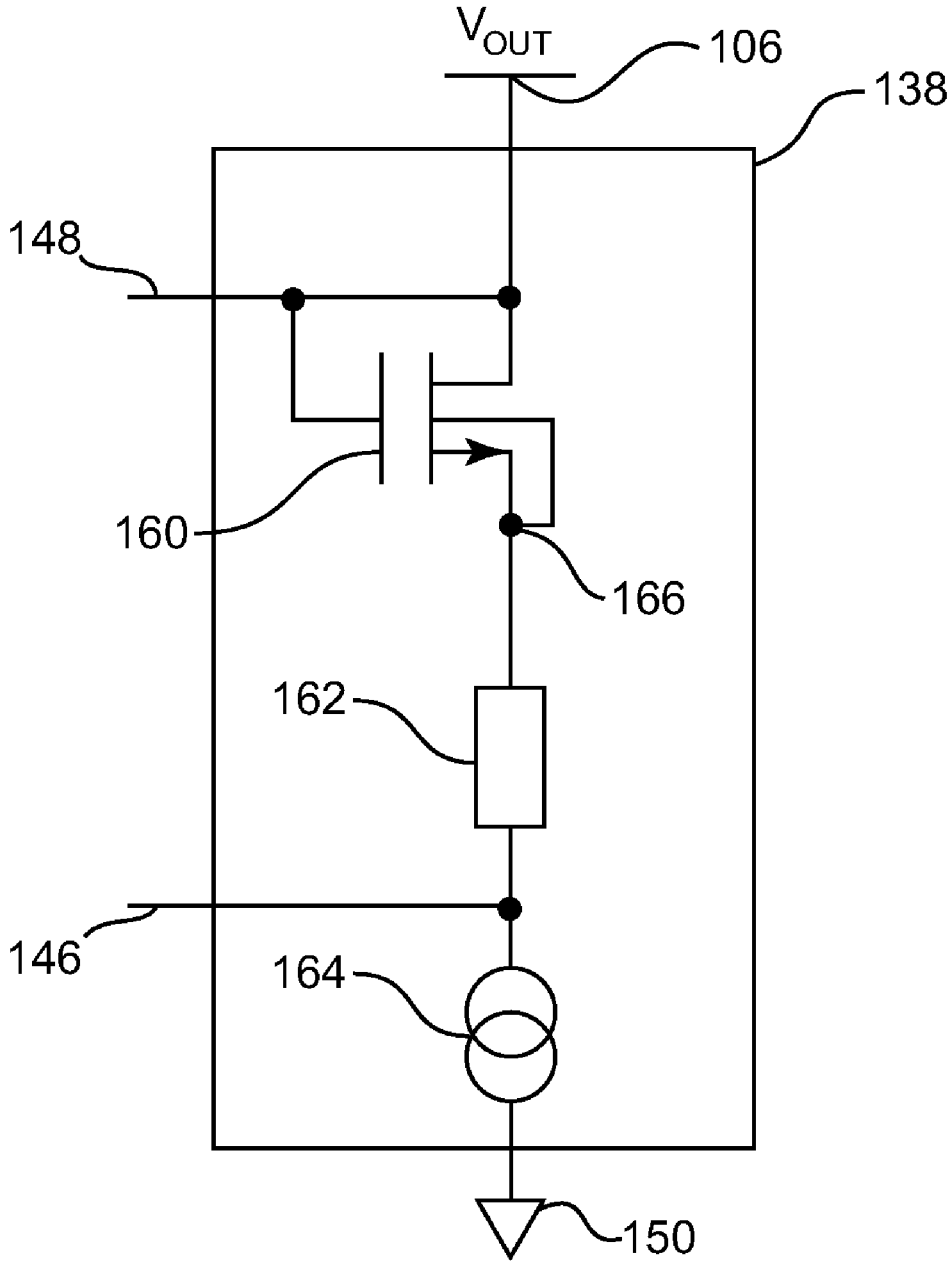
FIG. 3 is a diagram illustrating one embodiment of a compensation circuit that provides an offset voltage.

FIG. 3 is a diagram illustrating one embodiment of compensation circuit 138 that provides the offset voltage across compensation output paths 146 and 148. Compensation circuit 138 is electrically coupled to output line 106 and to the circuit reference at 150. In this embodiment, compensation circuit 138 provides an offset voltage that is referenced to output voltage VOUT at 106 and adjusted to compensate for variations in regulation transistor 110.

Compensation circuit 138 includes an NMOS compensation transistor 160, a resistor 162 and a current source 164. The gate and drain of compensation transistor 160 are electrically coupled to output line 106, which is electrically coupled to compensation output path 148. The body and source of compensation transistor 160 are electrically coupled to one end of resistor 162 via source path 166 and the other end of resistor 162 is electrically coupled to one end of current source 164 via compensation output path 146. The other end of current source 164 is electrically coupled to the circuit reference at 150.

In operation, compensation transistor 160 receives the regulated output voltage VOUT at 106 and current flows through compensation transistor 160 and resistor 162. The voltage across compensation transistor 160 from output line 106 to source path 166 is substantially equal to a threshold voltage Vt plus a saturation voltage Vdsat. This voltage is added to the voltage drop across resistor 162 to obtain the offset voltage across compensation output paths 146 and 148. In LDO voltage regulator 100, the offset voltage is added to the control voltage from OTA 122 to provide the gate drive voltage for regulation transistor 110.

NMOS compensation transistor 160 is similar to NMOS regulation transistor 110, such that changes in temperature and/or changes in the technology/process similarly affect both compensation transistor 160 and regulation transistor 110. Thus, compensation transistor 160 adjusts the offset voltage to compensate for variations in regulation transistor 110.

Current source 164 sinks the current that flows through compensation transistor 160 and resistor 162. Also, current source 164 substantially isolates the offset voltage from the circuit reference at 150, which reduces noise in the offset voltage and provides an offset voltage that is referenced to the regulated output voltage VOUT at 106.

Figure 4:
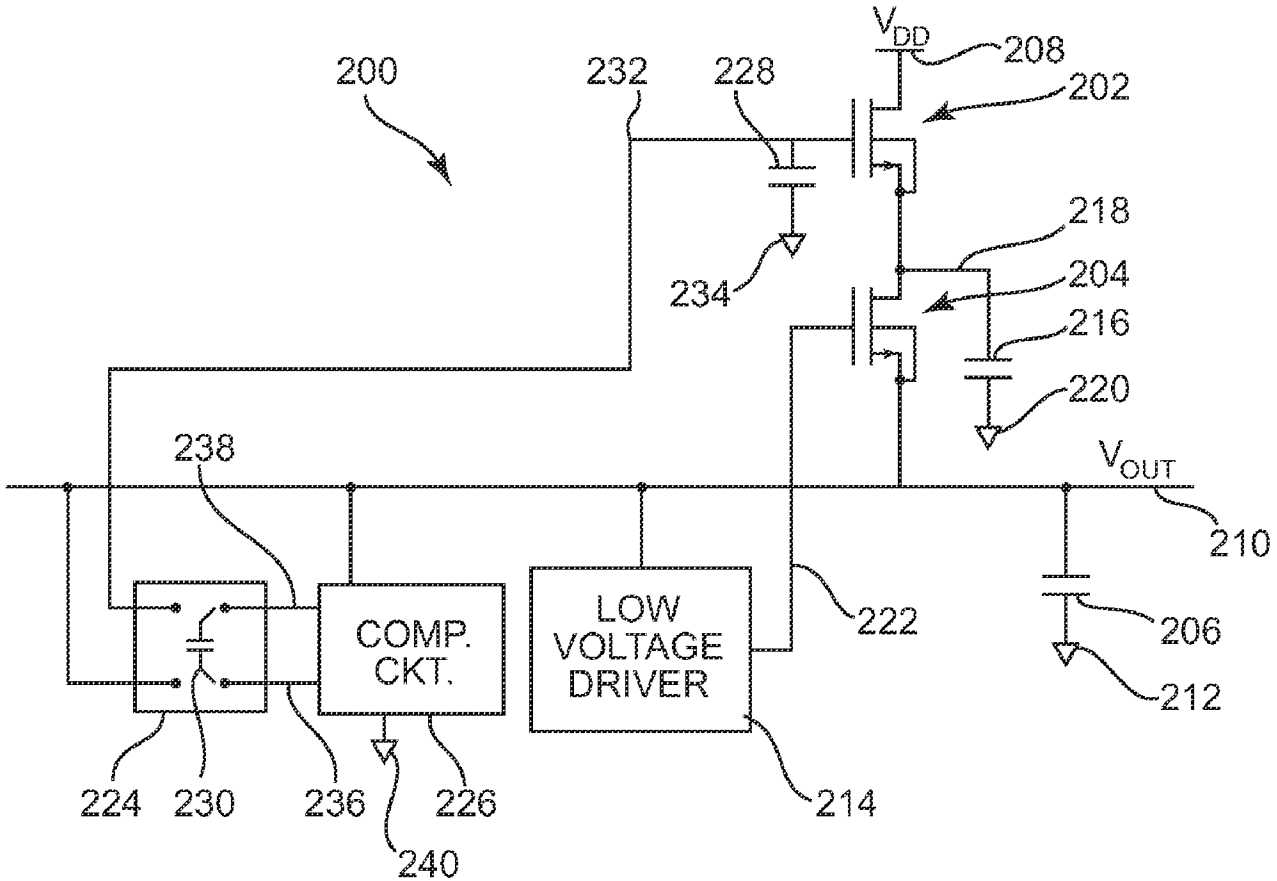
FIG. 4 is a diagram illustrating one embodiment of an LDO voltage regulator including a cascode transistor and a regulation transistor.

FIG. 4 is a diagram illustrating one embodiment of an LDO voltage regulator 200 including a cascode transistor 202 and a regulation transistor 204, and coupled to a load capacitance 206. LDO voltage regulator 200 receives power supply voltage VDD at 208 and provides regulated output voltage VOUT at 210. One end of load capacitance 206 is electrically coupled to the output of LDO voltage regulator 200 via output line 210 and the other end of load capacitance 206 is electrically coupled to a circuit reference, such as ground, at 212. Load capacitance 206 is substantially determined by the connected load. LDO voltage regulator 200 is similar to voltage regulator 22 (shown in FIG. 1).

LDO voltage regulator 200 includes cascode transistor 202, regulation transistor 204, a low voltage driver 214 and a capacitor 216. Cascode transistor 202 is a high voltage NMOS transistor coupled in series with regulation transistor 204 between power supply voltage VDD at 208 and output voltage VOUT at 210. The drain of cascode transistor 202 is electrically coupled to power supply voltage VDD at 208. The body and source of cascode transistor 202 is electrically coupled to the drain of regulation transistor 204 and one end of capacitor 216 via series transistor path 218. The other end of capacitor 216 is electrically coupled to a circuit reference, such as ground, at 220. Regulation transistor 204 is a low voltage NMOS transistor in a source follower configuration, where the body and source of regulation transistor 204 are electrically coupled to load capacitance 206 via output line 210. Low voltage driver 214 is electrically coupled to the gate of regulation transistor 204 via control input path 222 and to the output of LDO voltage regulator 200 via output line 210. The gate of regulation transistor 204 is a control input driven by low voltage driver 214.

Low voltage driver 214 receives regulated output voltage VOUT at 210 and provides a driver voltage to the gate of regulation transistor 204 via control input path 222. In one embodiment, low voltage driver 214 includes a resistor that compensates for a threshold voltage Vt plus a saturation voltage Vdsat of regulation transistor 204. In one embodiment, low voltage driver 214 is the same as low voltage driver 112 (shown in FIG. 2).

LDO voltage regulator 200 includes a switching circuit 224, a cascode compensation circuit 226 and a cascode compensation capacitor 228. Switching circuit 224 is substantially represented via switched capacitor 230 and includes two output paths and two input paths. One output path is electrically coupled to the output of LDO voltage regulator 200 via output line 210 and the other output path is electrically coupled to the gate of cascode transistor 202 and one end of compensation capacitor 228 via control input path 232. The gate of cascode transistor 202 is a control input driven by the voltage on the control input path 232. The other end of compensation capacitor 228 is electrically coupled to a circuit reference, such as ground, at 234. One input path of switching circuit 224 is electrically coupled to one output of compensation circuit 226 via compensation output path 236 and the other input path is electrically coupled to another output of compensation circuit 226 via compensation output path 238. Compensation circuit 226 is electrically coupled to the output of LDO voltage regulator 200 via output line 210 and to a circuit reference, such as ground, at 240.

Compensation circuit 226 provides a shift voltage or offset voltage across compensation output paths 236 and 238, which is switched onto switched capacitor 230. In one embodiment, compensation circuit 226 is referenced to output voltage VOUT at 210 and not to the circuit reference, such as ground, at 240. In one embodiment, compensation circuit 226 provides an offset voltage that is adjusted to compensate for variations in cascode transistor 202. In one embodiment, compensation circuit 226 is referenced to output voltage VOUT at 210 and not to the circuit reference, such as ground, at 240 and compensation circuit 226 provides an offset voltage that is adjusted to compensate for variations in cascode transistor 202. In one embodiment, compensation circuit 226 includes a transistor that is similar to cascode transistor 202, such that the offset voltage is adjusted to compensate for variations in cascode transistor 202. In one embodiment, compensation circuit 226 adjusts the offset voltage to compensate for variations in cascode transistor 202, such as temperature and process changes.

Switching circuit 224 receives the offset voltage from compensation circuit 226 and switches the offset voltage onto switched capacitor 230. Switching circuit 224 provides the offset voltage from switched capacitor 230 to control input path 232. The offset voltage is added to the output voltage VOUT at 210 to provide the drive voltage on control input line 232 and on compensation capacitor 228. The drive voltage on control input line 232 controls cascode transistor 202. In one embodiment, switching circuit 224 operates at greater than 100 kHz. In one embodiment, switching circuit 224 operates at greater than 1 MHz.

In operation, compensation capacitor 228 stabilizes the drive voltage of cascode transistor 202 and contributes to providing improved ripple rejection, where PSRR is a combination of the PSRR contributed via cascode transistor 202 and the PSRR contributed via regulation transistor 204. The maximum PSRR is limited by the relationships of: 1) the drain to gate capacitance of regulation transistor 204 divided by the capacitance of a regulation compensation capacitor and 2) the drain to gate capacitance of cascode transistor 202 divided by the capacitance of compensation capacitor 228. In one embodiment, PSRR is improved to about −60 dB. In one embodiment, the voltage drop across cascode transistor 202 can be reduced to less than 0.15 volts and the voltage drop across regulation transistor 204 can be reduced to less than 0.15 volts to provide a LDO regulated output voltage VOUT at 210.

Figure 5:
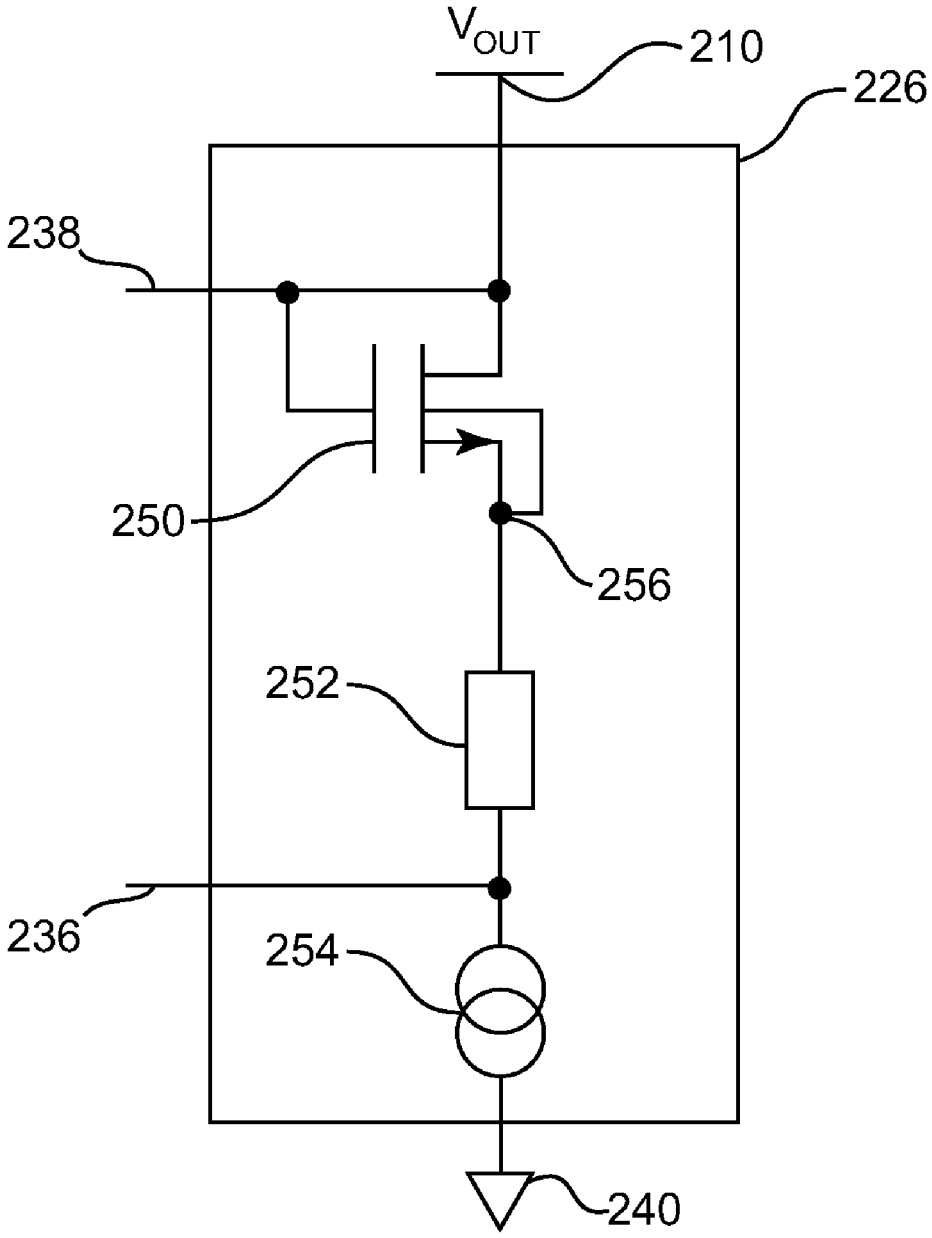
FIG. 5 is a diagram illustrating one embodiment of a cascode compensation circuit that provides an offset voltage.

FIG. 5 is a diagram illustrating one embodiment of cascode compensation circuit 226 that provides the offset voltage across compensation output paths 236 and 238. Compensation circuit 226 is electrically coupled to output line 210 and to the circuit reference at 240. In this embodiment, compensation circuit 226 provides an offset voltage that is referenced to output voltage VOUT at 210 and adjusted to compensate for variations in cascode transistor 202.

Compensation circuit 226 includes an NMOS compensation transistor 250, a resistor 252 and a current source 254. The gate and drain of compensation transistor 250 are electrically coupled to output line 210, which is electrically coupled to compensation output path 238. The body and source of compensation transistor 250 are electrically coupled to one end of resistor 252 via source path 256 and the other end of resistor 252 is electrically coupled to one end of current source 254 via compensation output path 236. The other end of current source 254 is electrically coupled to the circuit reference at 240.

In operation, compensation transistor 250 receives the regulated output voltage VOUT at 210 and current flows through compensation transistor 250 and resistor 252. The voltage across compensation transistor 250 from output line 210 to source path 256 is substantially equal to a threshold voltage Vt plus two saturation voltages Vdsat. This voltage is added to the voltage drop across resistor 252 to obtain the offset voltage across compensation output paths 236 and 238. The offset voltage is added to the output voltage VOUT at 210 to provide the gate drive voltage for cascode transistor 202.

NMOS compensation transistor 250 is similar to high voltage NMOS cascode transistor 202, such that changes in temperature and/or changes in the technology/process similarly affect both compensation transistor 250 and cascode transistor 202. Thus, compensation transistor 250 adjusts the offset voltage to compensate for variations in cascode transistor 202.

Current source 254 sinks the current that flows through compensation transistor 250 and resistor 252. Also, current source 254 substantially isolates the offset voltage from the circuit reference at 240, which reduces noise in the offset voltage and provides an offset voltage that is referenced to the regulated output voltage VOUT at 210.

Figure 6:
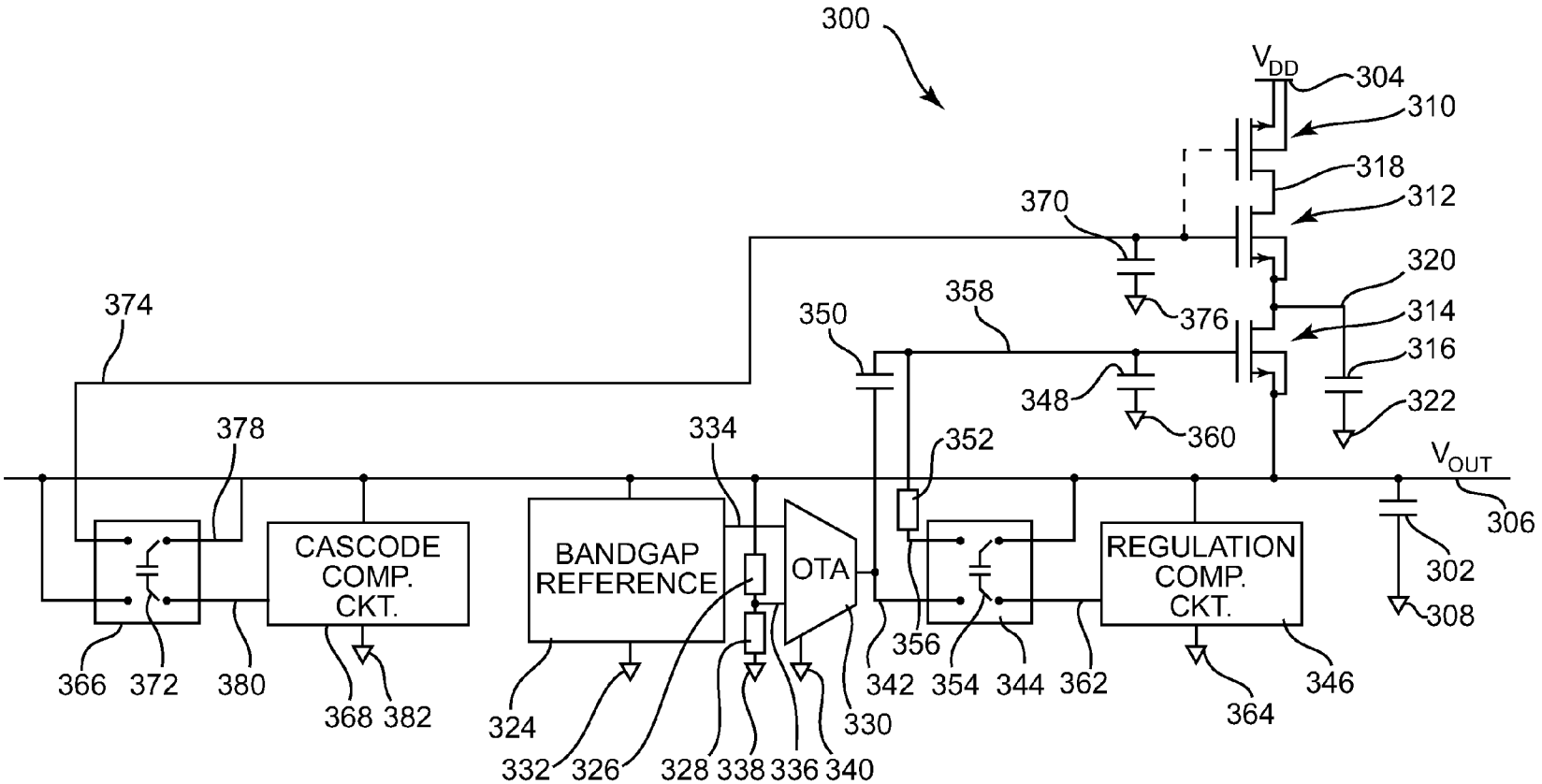
FIG. 6 is a diagram illustrating one embodiment of a LDO voltage regulator including a low voltage driver circuit and reverse power supply protection.

FIG. 6 is a diagram illustrating one embodiment of a LDO voltage regulator 300 including a different low voltage driver circuit and reverse power supply protection, and coupled to a load capacitance 302. LDO voltage regulator 300 receives power supply voltage VDD at 304 and provides regulated output voltage VOUT at 306. One end of load capacitance 302 is electrically coupled to the output of LDO voltage regulator 300 via output line 306 and the other end of load capacitance 302 is electrically coupled to a circuit reference, such as ground, at 308. Load capacitance 302 is substantially determined by the connected load. LDO voltage regulator 300 is similar to voltage regulator 22 (shown in FIG. 1).

LDO voltage regulator 300 includes a reverse power supply protection transistor 310, a cascode transistor 312, a regulation transistor 314 and a capacitor 316. Protection transistor 310 is an NMOS transistor coupled in series with cascode transistor 312 and regulation transistor 314 between power supply voltage VDD at 304 and output voltage VOUT at 306. The body and source of protection transistor 310 is electrically coupled to power supply voltage VDD at 304, and the drain of protection transistor 310 is electrically coupled to the drain of cascode transistor 312 via first series transistor path 318. Cascode transistor 312 is a high voltage NMOS transistor and the body and source of cascode transistor 312 is electrically coupled to the drain of regulation transistor 314 and one end of capacitor 316 via second series transistor path 320. The other end of capacitor 316 is electrically coupled to a circuit reference, such as ground, at 322. Regulation transistor 314 is a low voltage NMOS transistor in a source follower configuration, where the body and source of regulation transistor 314 are electrically coupled to load capacitance 302 via output line 306.

To provide a drive voltage to the gate of regulation transistor 314, LDO voltage regulator 300 includes a control loop referenced to output voltage VOUT at 306. LDO voltage regulator 300 includes a bandgap reference 324, a resistor divide network including top resistor 326 and bottom resistor 328 and an OTA 330. Bandgap reference 324 is electrically coupled to the output of LDO voltage regulator 300 via output line 306 and to a circuit reference, such as ground, at 332. Bandgap reference 324 is also electrically coupled to one input of OTA 330 via reference input path 334. One end of top resistor 326 is electrically coupled to the output of LDO voltage regulator 300 via output line 306 and the other end of top resistor 326 is electrically coupled to one end of bottom resistor 328 and the other input of OTA 330 via feedback input path 336. The other end of bottom resistor 328 is electrically coupled to a circuit reference, such as ground, at 338. OTA 330 is electrically coupled to the output of LDO voltage regulator 300 via output line 306 and to a circuit reference, such as ground, at 340.

Bandgap reference 324 provides a reference voltage to the one input of OTA 330 via reference input path 334 and the resistor divide network, including resistors 326 and 328, feeds back a feedback voltage to the other input of OTA 330 via feedback input path 336. The resistor divide network receives output voltage VOUT at 306 and provides a fraction of output voltage VOUT at 306 as the feedback voltage at 336. OTA 330 receives the reference voltage and the feedback voltage and provides a control voltage on OTA output path 342. The control voltage corresponds to the difference between the reference voltage and the feedback voltage.

LDO voltage regulator 300 also includes a switching circuit 344, a regulation compensation circuit 346, a regulation compensation capacitor 348, a driver capacitor 350 and a resistor 352. Switching circuit 344 is substantially represented via switched capacitor 354 and includes two output paths and two input paths. One output path is electrically coupled to the output of OTA 330 and one end of driver capacitor 350 via OTA output path 342. The other output path is electrically coupled to one end of resistor 352 via switching output path 356. The other end of resistor 352 is electrically coupled to the other end of driver capacitor 350 and the gate of regulation transistor 314 and one end of compensation capacitor 348 via control input path 358. The other end of compensation capacitor is electrically coupled to a reference, such as ground, at 360. One input path is electrically coupled to one output of compensation circuit 346 via compensation output path 362 and the other input path is electrically coupled to the output of LDO voltage regulator 300 via output line 306. Compensation circuit 346 is electrically coupled to the output of LDO voltage regulator 300 via output line 306 and to a circuit reference, such as ground, at 364.

Compensation circuit 346 provides an offset voltage, which is switched onto switched capacitor 354. In one embodiment, compensation circuit 346 is the same as compensation circuit 138 of FIG. 3. In one embodiment, compensation circuit 346 is referenced to output voltage VOUT at 306 and not to the circuit reference, such as ground, at 364. In one embodiment, compensation circuit 346 provides an offset voltage that is adjusted to compensate for variations in regulation transistor 314. In one embodiment, compensation circuit 346 is referenced to output voltage VOUT at 306 and not to the circuit reference, such as ground, at 364 and compensation circuit 346 provides an offset voltage that is adjusted to compensate for variations in regulation transistor 314. In one embodiment, compensation circuit 346 includes a transistor that is similar to regulation transistor 314, such that the offset voltage is adjusted to compensate for variations in regulation transistor 314. In one embodiment, compensation circuit 346 adjusts the offset voltage to compensate for variations in regulation transistor 314, such as temperature and process changes.

Switching circuit 344 provides the offset voltage from switched capacitor 354 to driver capacitor 350 via resistor 352, such that driver capacitor 350 operates similar to a battery. Resistor 352 dampens current and voltage spikes. In one embodiment, switching circuit 344 operates at greater than 100 kHz. In one embodiment, switching circuit 344 operates at greater than 1 MHz.

In operation, OTA 330 provides a control voltage at 342 that corresponds to the difference between the reference voltage and the feedback voltage, where the feedback voltage corresponds to the output voltage VOUT at 306. The offset voltage across driver capacitor 354 is added to the control voltage at 342 to provide a driving voltage on control input path 358. This driving voltage at 358 drives and controls regulation transistor 314 to regulate output voltage 306.

LDO voltage regulator 300 also includes a switching circuit 366, a cascode compensation circuit 368 and a cascode compensation capacitor 370. Switching circuit 366 is substantially represented via switched capacitor 372 and includes two output paths and two input paths. One output path is electrically coupled to the output of LDO voltage regulator 300 via output line 306 and the other output path is electrically coupled to the gate of cascode transistor 312 and one end of compensation capacitor 370 via control input path 374. Optionally, the other output path is also electrically coupled to the gate of protection transistor 310 via control input path. The gate of cascode transistor 312 is a control input driven by the voltage on the control input path 374. The other end of compensation capacitor 370 is electrically coupled to a circuit reference, such as ground, at 376. One input path of switching circuit 366 is electrically coupled to one output of compensation circuit 368 via compensation output path 378 and the other input path is electrically coupled to another output of compensation circuit 368 via compensation output path 380. Compensation circuit 368 is electrically coupled to the output of LDO voltage regulator 300 via output line 306 and to a circuit reference, such as ground, at 382.

Compensation circuit 368 provides a shift voltage or offset voltage across compensation output paths 378 and 380, which is switched onto switched capacitor 372. In one embodiment, compensation circuit 368 is the same as compensation circuit 226 of FIG. 5. In one embodiment, compensation circuit 368 is referenced to output voltage VOUT at 306 and not to the circuit reference, such as ground, at 382. In one embodiment, compensation circuit 368 provides an offset voltage that is adjusted to compensate for variations in cascode transistor 312. In one embodiment, compensation circuit 368 is referenced to output voltage VOUT at 306 and not to the circuit reference, such as ground, at 382 and compensation circuit 368 provides an offset voltage that is adjusted to compensate for variations in cascode transistor 312. In one embodiment, compensation circuit 368 includes a transistor that is similar to cascode transistor 312, such that the offset voltage is adjusted to compensate for variations in cascode transistor 312. In one embodiment, compensation circuit 368 adjusts the offset voltage to compensate for variations in cascode transistor 312, such as temperature and process changes.

Switching circuit 366 receives the offset voltage from compensation circuit 368 and switches the offset voltage onto switched capacitor 372. Switching circuit 366 provides the offset voltage from switched capacitor 372 to control input path 374. The offset voltage is added to the output voltage VOUT at 306 to provide the drive voltage on control input path 374 and on compensation capacitor 370. The drive voltage on control input path 374 controls cascode transistor 312. In one embodiment, switching circuit 366 operates at greater than 100 kHz. In one embodiment, switching circuit 366 operates at greater than 1 MHz.

In operation, regulation compensation capacitor 348 stabilizes output voltage VOUT at 306 and cascode compensation capacitor 370 stabilizes the drive voltage of cascode transistor 312. Both regulation compensation capacitor 348 and cascode compensation capacitor 370 contribute to providing improved ripple rejection, where PSRR is a combination of the PSRR contributed via cascode transistor 312 and the PSRR contributed via regulation transistor 314. The maximum PSRR is limited by the relationships of: 1) the drain to gate capacitance of regulation transistor 314 divided by the capacitance of regulation compensation capacitor 348 and 2) the drain to gate capacitance of cascode transistor 312 divided by the capacitance of cascode compensation capacitor 370. In one embodiment, PSRR is improved to about −60 dB. In one embodiment, the voltage drop across protection transistor 310 can be reduced to less than 0.15 volts and the voltage drop across cascode transistor 312 can be reduced to less than 0.15 volts and the voltage drop across regulation transistor 314 can be reduced to less than 0.15 volts to provide a LDO regulated output voltage VOUT at 306.

Figure 7:
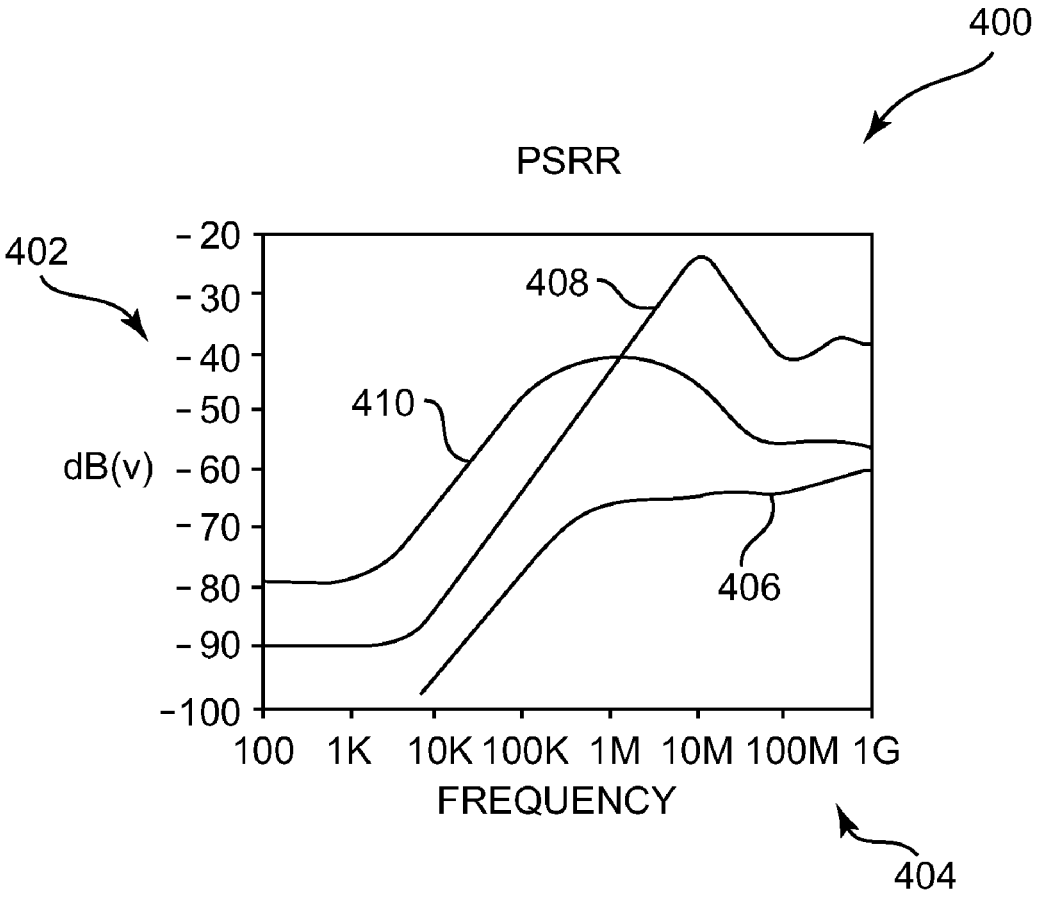
FIG. 7 is a diagram illustrating PSRR simulation results for three different LDO voltage regulators.

FIG. 7 is a diagram illustrating PSRR simulation results 400 for three different LDO voltage regulators. PSRR is graphed in decibels at 402 versus frequency in Hz at 404.

The PSRR of an LDO voltage regulator such as LDO voltage regulator 200 or LDO voltage regulator 300 is graphed at 406, where the PSRR at 406 is at −100 dB at about 10 kHz and rises to about −60 dB at 1 GHz. In contrast, the PSRR of a pnp LDO voltage regulator is graphed at 408, where the PSRR at 408 is at −90 dB at 100 Hz and rises to almost −20 dB at about 10 MHz and is at about −40 dB at 1 GHz. Also, the PSRR of an npn voltage regulator is graphed at 410, where the PSRR at 410 is at about −80 dB at 100 Hz and rises to about −40 dB at 1 MHz and about −55 dB at 1 GHZ. Thus, the LDO voltage regulators 200 and 300 provide improved PSRR over these and other regulators.

Figure 8:
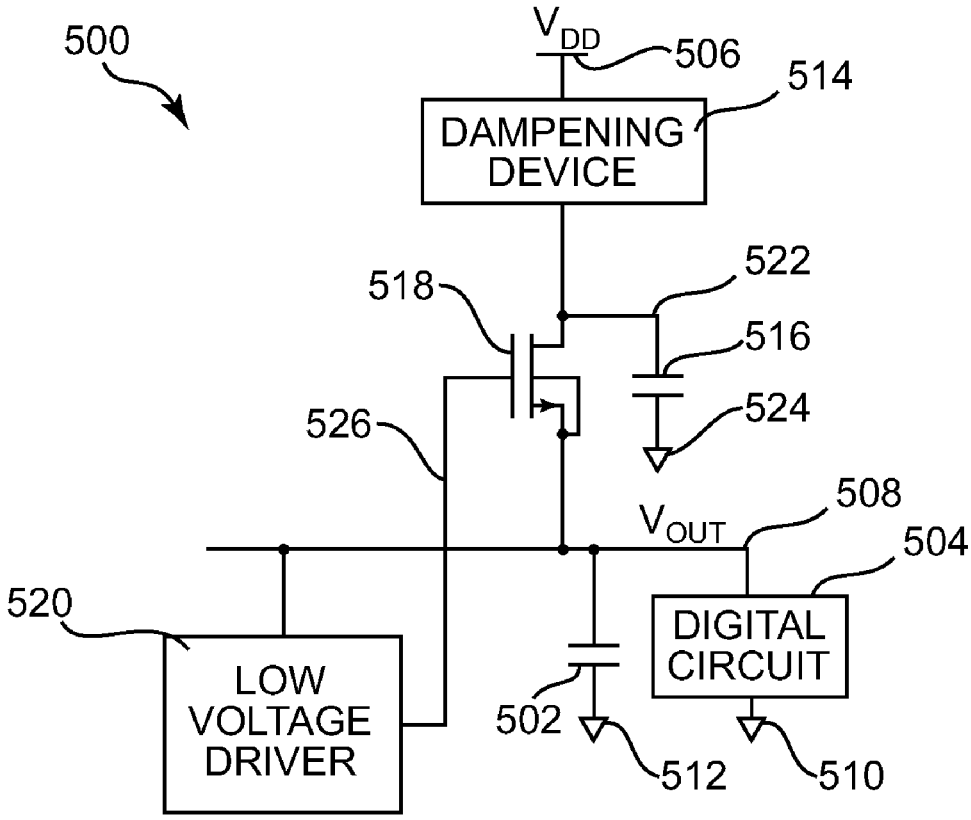
FIG. 8 is a diagram illustrating one embodiment of a LDO voltage regulator coupled to a load capacitance and a digital circuit.

FIG. 8 is a diagram illustrating one embodiment of a LDO voltage regulator 500 coupled to a load capacitance 502 and a digital circuit 504. LDO voltage regulator 500 receives power supply voltage VDD at 506 and provides regulated output voltage VOUT at 508. LDO voltage regulator 500 is similar to voltage regulator 22 (shown in FIG. 1).

Digital circuit 504 and one end of load capacitance 502 are electrically coupled to the output of LDO voltage regulator 500 via output line 508. Digital circuit 504 is electrically coupled to a circuit reference, such as ground, at 510, and the other end of load capacitance 502 is electrically coupled to a circuit reference, such as ground, at 512. Load capacitance 502 is substantially determined by the connected load. Digital circuit 504 generates current spikes, such as switching current spikes and current spikes due to pre-loading and un-loading of capacitances.

LDO voltage regulator 500 includes a damping device 514, a tank capacitor 516, a regulation transistor 518 and a low voltage driver 520. Damping device 514 is electrically coupled to power supply voltage VDD at 506 and to the drain of regulation transistor 518 and one end of tank capacitor 516 via current path 522. Regulation transistor 518 is an NMOS transistor in a source follower configuration and the body and source of regulation transistor 518 are electrically coupled to load capacitance 502 and digital circuit 504 via output line 508. The other end of tank capacitor 516 is electrically coupled to a circuit reference, such as ground, at 524.

Low voltage driver 520 is electrically coupled to the gate of regulation transistor 518 via control input path 526 and to the output of LDO voltage regulator 500 via output line 508. The gate of regulation transistor 518 is a control input driven by low voltage driver 520. Low voltage driver 520 receives regulated output voltage VOUT at 508 and provides a driver voltage to the gate of regulation transistor 518 via control input path 526. In one embodiment, low voltage driver 520 is similar to low voltage driver 112 (shown in FIG. 2). In one embodiment, low voltage driver 520 is similar to low voltage driver 214 (shown in FIG. 4). In one embodiment, low voltage driver 520 is similar to the circuitry that drives regulation transistor 314 (shown in FIG. 6).

Damping device 514 receives current from the power supply at 506 and provides current to tank capacitor 516 and regulation transistor 518. In one embodiment, damping device 514 is a current source. In one embodiment, damping device 514 is a regulated current source. In one embodiment, damping device 514 is a resistor. In one embodiment, damping device 514 is an OTA.

In operation, digital circuit 504 generates current spikes and LDO voltage regulator 500 responds by providing current to digital circuit 504. Regulation transistor 518 is biased on to provide current for the current spikes, where the current is at least partially drawn from tank capacitor 516. In the process, tank capacitor 516 discharges and damping circuit 514 provides current to recharge tank capacitor 516. Filling current needs via tank capacitor 516 reduces current spiking on the power supply line at 506, which reduces EMI.

Figure 9:
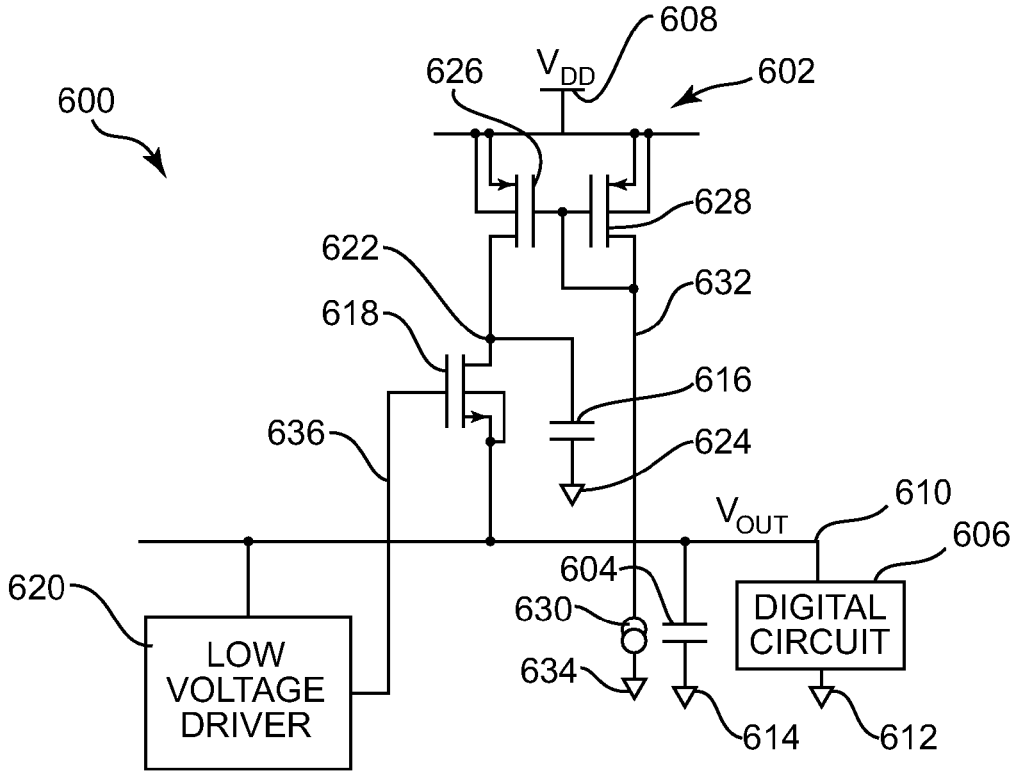
FIG. 9 is a diagram illustrating one embodiment of a LDO voltage regulator including a current source and coupled to a load capacitance and a digital circuit.

FIG. 9 is a diagram illustrating one embodiment of a LDO voltage regulator 600 including a current source 602 and coupled to a load capacitance 604 and a digital circuit 606. LDO voltage regulator 600 receives power supply voltage VDD at 608 and provides regulated output voltage VOUT at 610. LDO voltage regulator 600 is similar to voltage regulator 22 (shown in FIG. 1).

Digital circuit 606 and one end of load capacitance 604 are electrically coupled to the output of LDO voltage regulator 600 via output line 610. Digital circuit 606 is electrically coupled to a circuit reference, such as ground, at 612, and the other end of load capacitance 604 is electrically coupled to a circuit reference, such as ground, at 614. Load capacitance 604 is substantially determined by the connected load. Digital circuit 606 generates current spikes, such as switching current spikes and current spikes due to pre-loading and unloading of capacitances.

LDO voltage regulator 600 includes current source 602, a tank capacitor 616, a regulation transistor 618 and a low voltage driver 620. Current source 602 is electrically coupled to power supply voltage VDD at 608 and to the drain of regulation transistor 618 and one end of tank capacitor 616 via current path 622. Regulation transistor 618 is an NMOS transistor in a source follower configuration and the body and source of regulation transistor 618 are electrically coupled to load capacitance 604 and digital circuit 606 via output line 610. The other end of tank capacitor 616 is electrically coupled to a circuit reference, such as ground, at 624.

Current source 602 includes a current mirror pair of p-channel metal oxide semiconductor (PMOS) transistors

626 and 628 and a current source 630. The body and source of each of the PMOS transistors 626 and 628 are electrically coupled to power supply voltage VDD at 608. The gates of PMOS transistors 626 and 628 are electrically coupled together and to the drain of PMOS transistor 628 and one end of current source 630 via current source path 632. The other end of current source 630 is electrically coupled to a circuit reference, such as ground, at 634. The drain of PMOS transistor 626 is electrically coupled to the drain of regulation transistor 618 and one end of tank capacitor 616 via current path 622. In other embodiments, current source 602 can be a regulated current source.

Low voltage driver 620 is electrically coupled to the gate of regulation transistor 618 via control input path 636 and to the output of LDO voltage regulator 600 via output line 610. The gate of regulation transistor 618 is a control input driven by low voltage driver 620. Low voltage driver 620 receives regulated output voltage VOUT at 610 and provides a driver voltage to the gate of regulation transistor 618 via control input path 636. In one embodiment, low voltage driver 620 is similar to low voltage driver 112 (shown in FIG. 2). In one embodiment, low voltage driver 620 is similar to low voltage driver 214 (shown in FIG. 4). In one embodiment, low voltage driver 620 is similar to the circuitry that drives regulation transistor 314 (shown in FIG. 6). In one embodiment, low voltage driver 620 is similar to low voltage driver 520 (shown in FIG. 8).

In operation, digital circuit 606 generates current spikes and LDO voltage regulator 600 responds by providing current to digital circuit 606. Regulation transistor 618 is biased on to provide current for the current spikes, where the current is at least partially drawn from tank capacitor 616. In the process, tank capacitor 616 discharges to a lower voltage level. Current source 602 provides current to recharge tank capacitor 616, where the current mirror pair of PMOS transistors 626 and 628 receive current from the power supply at 608 and provide current to tank capacitor 616 and regulation transistor 618. Filling current needs via tank capacitor 616 reduces current spiking on the power supply line at 608, which reduces EMI.

Figure 10:
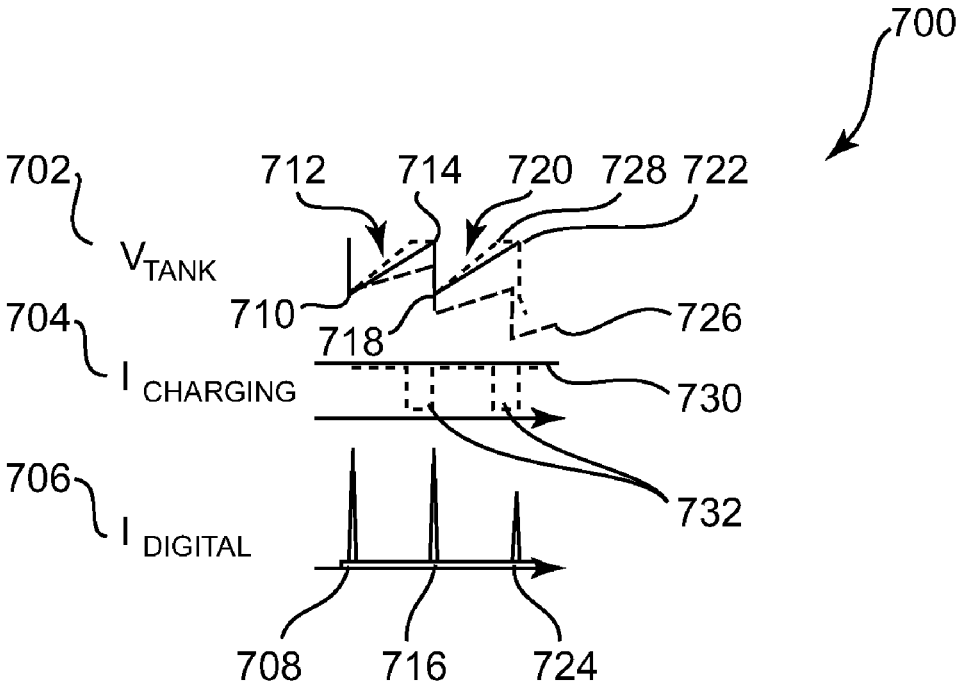
FIG. 10 is a diagram illustrating voltages and currents in a LDO voltage regulator.

FIG. 10 is a diagram illustrating voltages and currents at 700 in a LDO voltage regulator, such as LDO voltage regulator 500 of FIG. 8 and LDO voltage regulator 600 of FIG. 9. The voltage at 702 is the voltage on a tank capacitor, such as tank capacitor 516 or tank capacitor 616. The current at 704 is the current for charging the tank capacitor via a damping device, such as damping device 514 or current source 602. The current spikes at 706 are provided via a digital circuit, such as digital circuit 504 and digital circuit 606.

In response to the current spike at 708, the voltage on the tank capacitor drops to a low voltage value at 710, and the damping device charges the tank capacitor at 712 to a high voltage value at 714. In response to the current spike at 716, the voltage on the tank capacitor drops to a low voltage value at 718, and the damping device charges the tank capacitor at 720 to a high voltage value at 722. This is repeated in response to the current spike at 724.

If the damping device provides just the amount of current discharged from the tank capacitor, the voltage on the tank capacitor reaches the high voltage value just before discharging at 714 and 722. However, if the damping device provides less than the current previously discharged, i.e. underloads the tank capacitor, the voltage on the tank capacitor drifts low as indicated in dashed lines at 726. Also, if the damping device provides more than the current previously discharged, i.e. overloads the tank capacitor, the voltage on the tank capacitor reaches the high voltage value prior to discharging at 714 and 722 as indicated in dashed lines at 728.

Where the damping device provides just the amount of current discharged from the tank capacitor and where the damping device underloads the tank capacitor, the charging current at 704 remains constant at 730. However, where the damping device overloads the tank capacitor, the charging current at 704 is reduced or switches off prior to discharging the tank capacitor and the charging current switches back on after discharging the tank capacitor, indicated in dashed lines at 732. Switching the charging current at 704 off and on contributes to increasing EMI.

Figure 11:
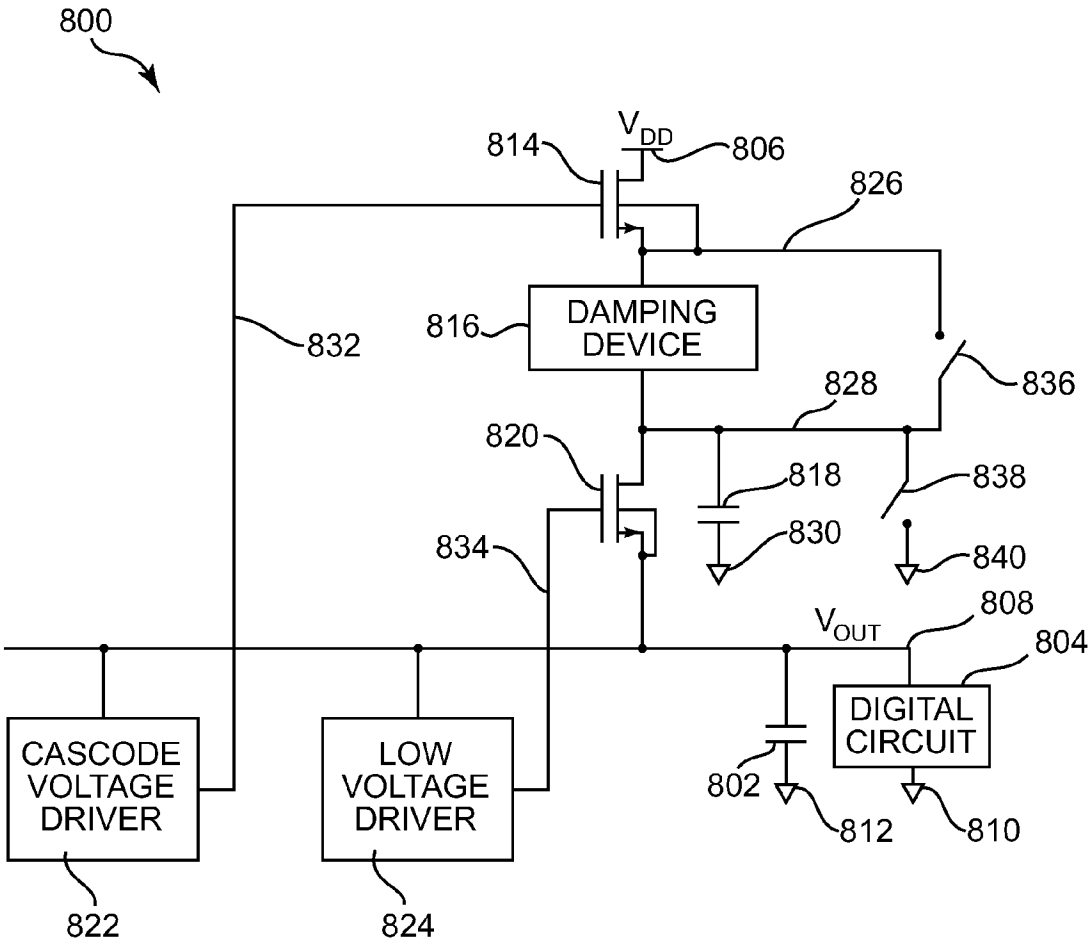
FIG. 11 is a diagram of a LDO voltage regulator that provides underload current and shunts away overload current.

FIG. 11 is a diagram of a LDO voltage regulator 800 that provides underload current and shunts away overload current to provide a substantially constant charging current. LDO voltage regulator 800 is coupled to a load capacitance 802 and a digital circuit 804. LDO voltage regulator 800 receives power supply voltage VDD at 806 and provides regulated output voltage VOUT at 808. LDO voltage regulator 800 is similar to voltage regulator 22 (shown in FIG. 1).

Digital circuit 804 and one end of load capacitance 802 are electrically coupled to the output of LDO voltage regulator 800 via output line 808. Digital circuit 804 is electrically coupled to a circuit reference, such as ground, at 810, and the other end of load capacitance 802 is electrically coupled to a circuit reference, such as ground, at 812. Load capacitance 802 is substantially determined by the connected load. Digital circuit 804 generates current spikes, such as switching current spikes and current spikes due to pre-loading and un-loading of capacitances.

LDO voltage regulator 800 includes a cascode transistor 814, a damping device 816, a tank capacitor 818, a regulation transistor 820, a cascode voltage driver 822 and a low voltage driver 824. Cascode transistor 814 is a high voltage NMOS transistor. The drain of cascode transistor 814 is electrically coupled to power supply voltage VDD at 806 and the body and source of cascode transistor 814 are electrically coupled to damping device 816 via current path 826. Damping device 816 is electrically coupled to the drain of regulation transistor 820 and one end of tank capacitor 818 via current path 828. Regulation transistor 820 is a low voltage NMOS transistor in a source follower configuration. The body and source of regulation transistor 820 are electrically coupled to load capacitance 802 and digital circuit 804 via output line 808. The other end of tank capacitor 818 is electrically coupled to a circuit reference, such as ground, at 830.

Cascode voltage driver 822 is electrically coupled to the gate of cascode transistor 814 via control input path 832 and to the output of LDO voltage regulator 800 via output line 808. The gate of cascode transistor 814 is a control input driven by cascode voltage driver 822. Cascode voltage driver 822 receives regulated output voltage VOUT at 808 and provides a driver voltage to the gate of cascode transistor 814 via control input path 832. In one embodiment, cascode voltage driver 822 is similar to the circuit that drives cascode transistor 202 (shown in FIG. 4) including switching circuit 224, cascode compensation circuit 226 and cascode compensation capacitor 228. In other embodiments, cascode voltage driver 822 is not coupled to the output of LDO voltage regulator 800, instead, cascode voltage driver 822 is electrically coupled to a different voltage source.

Low voltage driver 824 is electrically coupled to the gate of regulation transistor 820 via control input path 834 and to the output of LDO voltage regulator 800 via output line 808. The gate of regulation transistor 820 is a control input driven by low voltage driver 824. Low voltage driver 824 receives regulated output voltage VOUT at 808 and provides a driver voltage to the gate of regulation transistor 820 via control input path 834. In one embodiment, low voltage driver 824 is similar to low voltage driver 112 (shown in FIG. 2). In one embodiment, low voltage driver 824 is similar to low voltage driver 214 (shown in FIG. 4). In one embodiment, low voltage driver 824 is similar to the circuit that drives regulation transistor 314 (shown in FIG. 6). In one embodiment, low voltage driver 824 is similar to low voltage driver 520 (shown in FIG. 8). In one embodiment, low voltage driver 824 is similar to low voltage driver 620 (shown in FIG. 9).

Damping device 816 receives current from the power supply at 806 via cascode transistor 814 and provides current to tank capacitor 818 and regulation transistor 820. In one embodiment, damping device 816 is a current source. In one embodiment, damping device 816 is a regulated current source. In one embodiment, damping device 816 is a resistor. In one embodiment, damping device 816 is an OTA.

LDO voltage regulator 800 includes an underload switch 836 and an overload switch 838. One end of underload switch 836 is electrically coupled to the body and source of cascode transistor 814 via current path 826 and the other end of underload switch 836 is electrically coupled to the drain of regulation transistor 820 and one end of tank capacitor 818 via current path 828. One end of overload switch 838 is electrically coupled to damping device 816, the drain of regulation transistor 820 and one end of tank capacitor 818 via current path 828 and the other end of overload switch 838 is electrically coupled to a circuit reference, such as ground, at 840.

In operation, digital circuit 804 generates current spikes and LDO voltage regulator 800 responds by providing current to digital circuit 804. Regulation transistor 820 is biased on to provide current for the current spikes, where the current is at least partially drawn from tank capacitor 818. In the process, tank capacitor 818 discharges and damping device 816 provides current to recharge tank capacitor 818. If tank capacitor 818 is overloaded via damping device 816, overload switch 838 switches on to shunt current away from tank capacitor 818 and regulation transistor 820. This maintains a substantially constant current from damping device 816. If tank capacitor 818 is underloaded via damping device 816, underload switch 836 switches on to provide current from cascode transistor 814 to tank capacitor 818 and regulation transistor 820. This maintains a substantially constant current coming from damping device 816. Filling current needs via tank capacitor 818 and maintaining a substantially constant current from damping device 816 reduces current spiking on the power supply line at 806, which reduces EMI.

Figure 12:
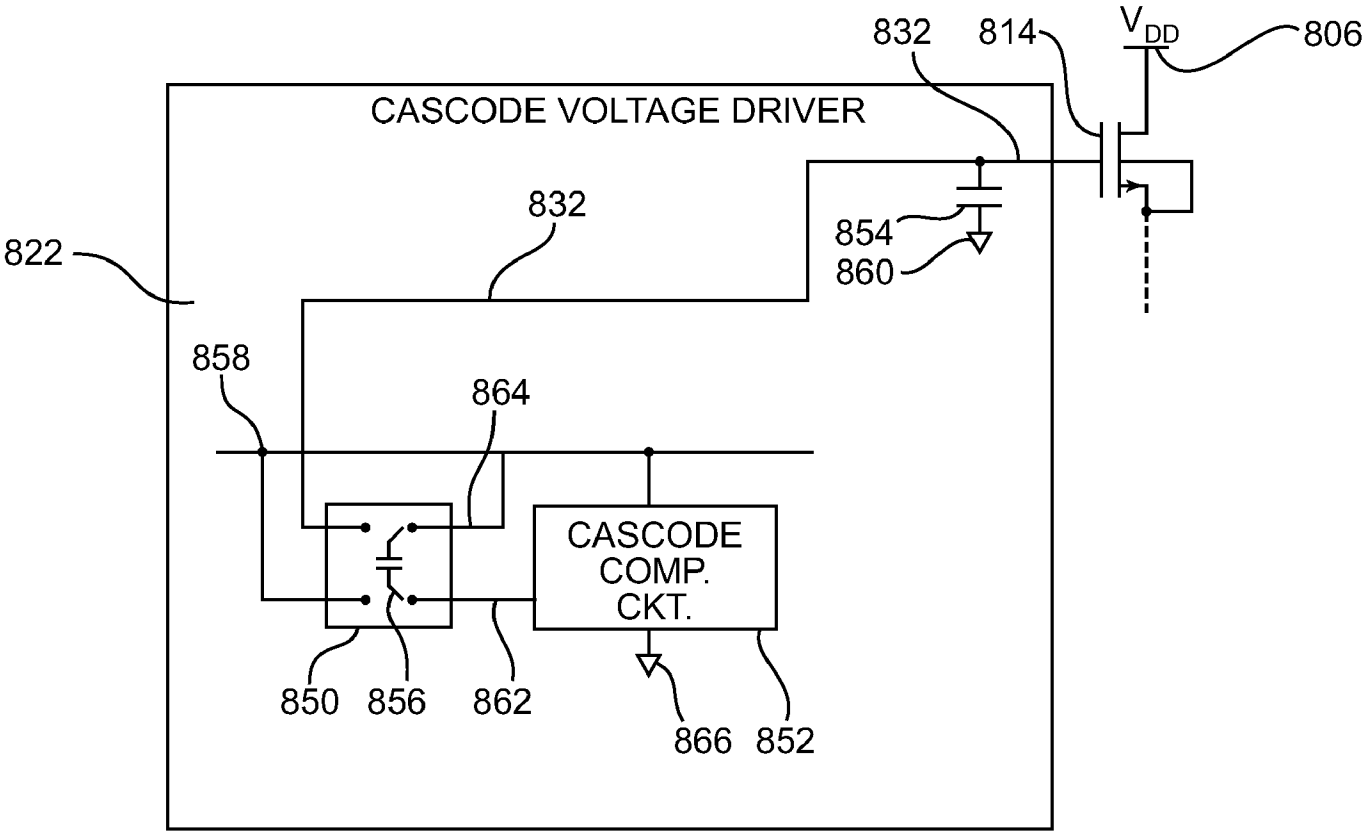
FIG. 12 is a diagram illustrating one embodiment of a cascode voltage driver coupled to a cascode transistor.

FIG. 12 is a diagram illustrating one embodiment of cascode voltage driver 822 electrically coupled to cascode transistor 814 via control input path 832. The drain of cascode voltage driver 814 is electrically coupled to power supply voltage 806.

Cascode voltage driver 822 includes a switching circuit 850, a cascode compensation circuit 852 and a cascode compensation capacitor 854. Switching circuit 850 is substantially represented via switched capacitor 856 and includes two output paths and two input paths. One output path is electrically coupled to a voltage source at 858, such as the output of LDO voltage regulator 800, and the other output path is electrically coupled to the gate of cascode transistor 814 and one end of compensation capacitor 854 via control input path 832. The gate of cascode transistor 814 is a control input driven by the voltage on the control input path 832. The other end of compensation capacitor 854 is electrically coupled to a circuit reference, such as ground, at 860. One input path of switching circuit 850 is electrically coupled to one output of compensation circuit 852 via compensation output path 862 and the other input path is electrically coupled to another output of compensation circuit 852 via compensation output path 864. Compensation circuit 852 is electrically coupled to the voltage source at 858, such as the output of LDO voltage regulator 800, and to a circuit reference, such as ground, at 866.

Compensation circuit 852 provides a shift voltage or offset voltage across compensation output paths 862 and 864, which is switched onto switched capacitor 856. In one embodiment, compensation circuit 852 is referenced to the voltage source at 858 and not to the circuit reference, such as ground, at 866. In one embodiment, compensation circuit 852 provides an offset voltage that is adjusted to compensate for variations in cascode transistor 814. In one embodiment, compensation circuit 852 is referenced to the voltage source at 858 and not to the circuit reference, such as ground, at 866 and compensation circuit 852 provides an offset voltage that is adjusted to compensate for variations in cascode transistor 814. In one embodiment, compensation circuit 852 includes a transistor that is similar to cascode transistor 814, such that the offset voltage is adjusted to compensate for variations in cascode transistor 814. In one embodiment, compensation circuit 852 adjusts the offset voltage to compensate for variations in cascode transistor 814, such as temperature and process changes. In one embodiment, compensation circuit 852 is similar to compensation circuit 226 of FIG. 5.

Switching circuit 850 receives the offset voltage from compensation circuit 852 and switches the offset voltage onto switched capacitor 856. Switching circuit 850 provides the offset voltage from switched capacitor 856 to control input path 832. The offset voltage is added to the voltage at 858 to provide the drive voltage on control input line 832 and on compensation capacitor 854. The drive voltage on control input line 832 controls cascode transistor 814. Compensation capacitor 854 stabilizes the drive voltage of cascode transistor 814 and contributes to providing improved ripple rejection. In one embodiment, switching circuit 850 operates at greater than 100 kHz. In one embodiment, switching circuit 850 operates at greater than 1 MHz.

Figure 13:
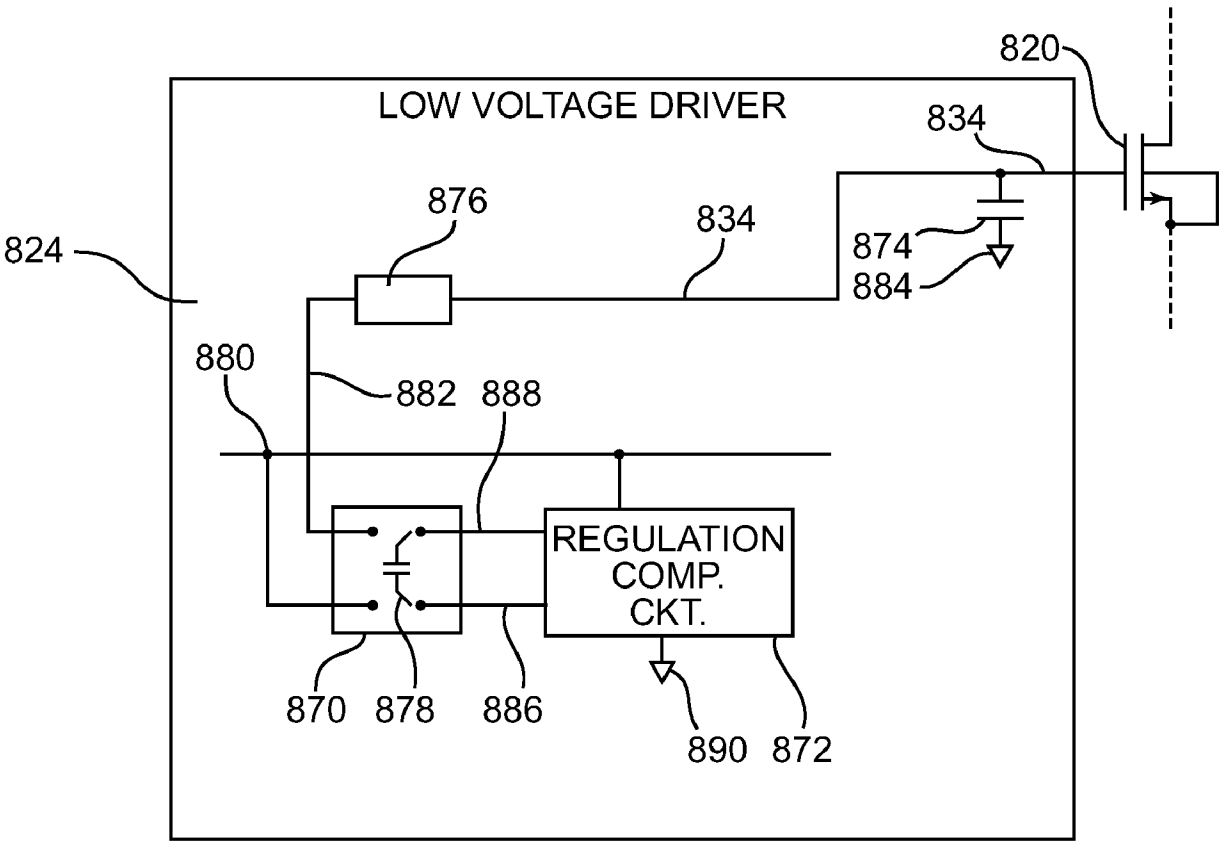
FIG. 13 is a diagram illustrating one embodiment of a low voltage driver coupled to the regulation transistor.

FIG. 13 is a diagram illustrating one embodiment of low voltage driver 824 electrically coupled to regulation transistor 820 via control input path 834. Low voltage driver 824 includes a switching circuit 870, a regulation compensation circuit 872, a regulation compensation capacitor 874 and a resistor 876. Switching circuit 870 is substantially represented via switched capacitor 878 and includes two output paths and two input paths. One output path is electrically coupled to a voltage source at 880, such as the output of LDO voltage regulator 800, and the other output path is electrically coupled to one end of resistor 876 via output path 882. The other end of resistor 876 is electrically coupled to the gate of regulation transistor 820 and one end of compensation capacitor 874 via control input path 834. The gate of regulation transistor 820 is a control input driven by the voltage on control input path 834. The other end of compensation capacitor 874 is electrically coupled to a circuit reference, such as ground, at 884.

One input path of switching circuit 870 is electrically coupled to one output of compensation circuit 872 via compensation output path 886 and the other input path is electrically coupled to another output of compensation circuit 872 via compensation output path 888. Compensation circuit 872 is electrically coupled to the voltage source at 880, such as the output of LDO voltage regulator 800, and to a circuit reference, such as ground, at 890.

Compensation circuit 872 provides a shift voltage or offset voltage across compensation output paths 886 and 888, which is switched onto switched capacitor 878. In one embodiment, compensation circuit 872 is referenced to the voltage source at 880 and not to the circuit reference, such as ground, at 890. In one embodiment, compensation circuit 872 provides an offset voltage that is adjusted to compensate for variations in regulation transistor 820. In one embodiment, compensation circuit 872 is referenced to the voltage source at 880 and not to the circuit reference, such as ground, at 890 and compensation circuit 872 provides an offset voltage that is adjusted to compensate for variations in regulation transistor 820. In one embodiment, compensation circuit 872 includes a transistor that is similar to regulation transistor 820, such that the offset voltage is adjusted to compensate for variations in regulation transistor 820. In one embodiment, compensation circuit 872 adjusts the offset voltage to compensate for variations in regulation transistor 820, such as temperature and process changes.

Switching circuit 870 receives the offset voltage from compensation circuit 872 and switches the offset voltage onto switched capacitor 878. Switching circuit 870 provides the offset voltage from switched capacitor 878 to control input path 834. The offset voltage is added to the voltage at 880 to provide the drive voltage on control input line 834 and compensation capacitor 874 via resistor 876. The drive voltage on control input line 834 controls regulation transistor 820. Compensation capacitor 874 stabilizes the drive voltage of regulation transistor 820 and contributes to providing improved ripple rejection. In one embodiment, switching circuit 870 operates at greater than 100 kHz. In one embodiment, switching circuit 870 operates at greater than 1 MHz.

Figure 14:
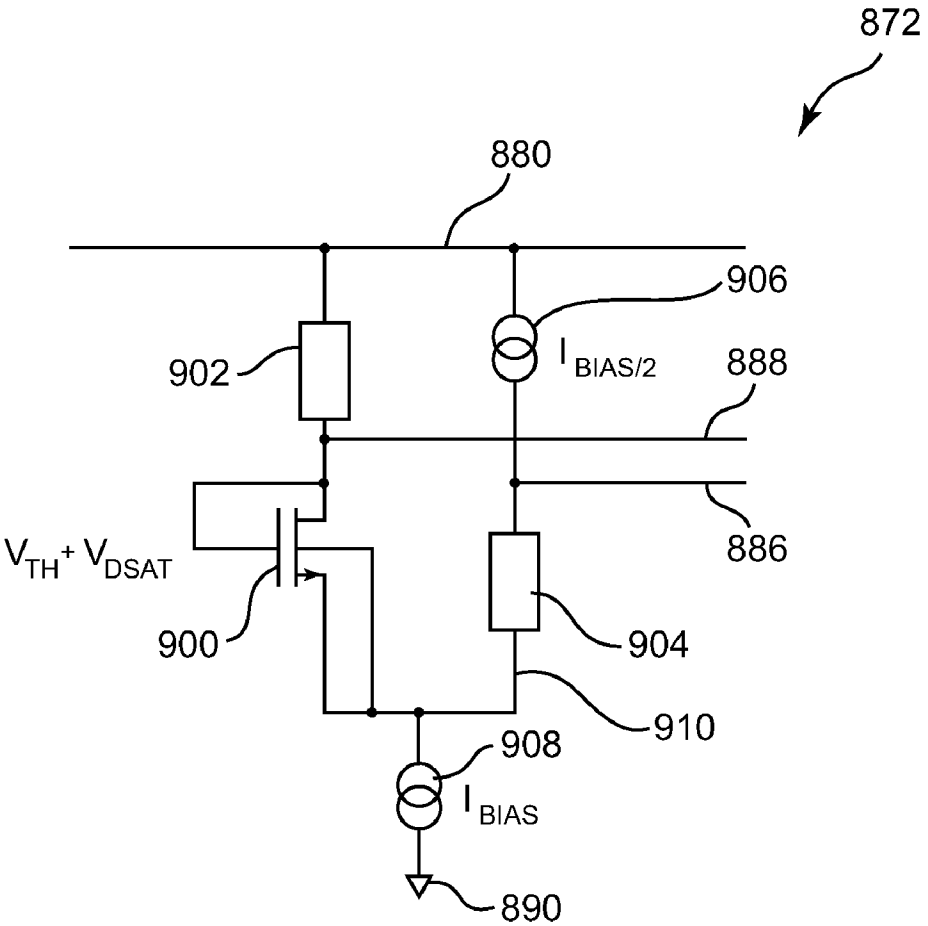
FIG. 14 is a diagram illustrating one embodiment of a regulation compensation circuit that provides an offset voltage.

FIG. 14 is a diagram illustrating one embodiment of a regulation compensation circuit 872 that provides the offset voltage across compensation output paths 886 and 888. Compensation circuit 872 is electrically coupled to a voltage source at 880 and to the circuit reference at 890. In this embodiment, compensation circuit 872 provides an offset voltage that is referenced to the voltage source at 880 and adjusted to compensate for variations in regulation transistor 820.

Compensation circuit 872 includes an NMOS compensation transistor 900, a first resistor 902, a second resistor 904, a first current source 906 and a second current source 908. One end of first resistor 902 is electrically coupled to the voltage source at 880 and the other end of first resistor 902 is electrically coupled to the gate and drain of compensation transistor 900 via compensation output path 888. One end of first current source 906 is electrically coupled to the voltage source at 880 and the other end of first current source 906 is electrically coupled to one end of second resistor 904 via compensation output path 886. The other end of second resistor 904 and the body and source of compensation transistor 900 are electrically coupled to one end of second current source 908 via bias current path 910. The other end of second current source 908 is electrically coupled to the circuit reference, such as ground, at 890.

In operation, second current source 908 provides bias current IBIAS and first current source 906 provides half the bias current IBIAS/2. Half of the bias current IBIAS flows through second resistor 904 to provide a voltage across second resistor 904 that is substantially equal to the difference between the voltage at 880 and output voltage VOUT at 808 (shown in FIG. 11). The other half of the bias current IBIAS flows through compensation transistor 900 to provide a voltage across compensation transistor 900 that is a threshold voltage VTH plus a saturation voltage VDSAT. The voltage across compensation output paths 886 and 888 is added to the voltage at 880 to provide the gate drive voltage for regulation transistor 820.

NMOS compensation transistor 900 is similar to NMOS regulation transistor 820, such that changes in temperature and/or changes in the technology/process similarly affect both compensation transistor 900 and regulation transistor 820. Thus, compensation transistor 900 adjusts the offset voltage to compensate for variations in regulation transistor 820. Also, second current source 908 substantially isolates the offset voltage from the circuit reference at 890, which reduces noise in the offset voltage and provides an offset voltage that is referenced to the voltage source at 880.

Figure 15:
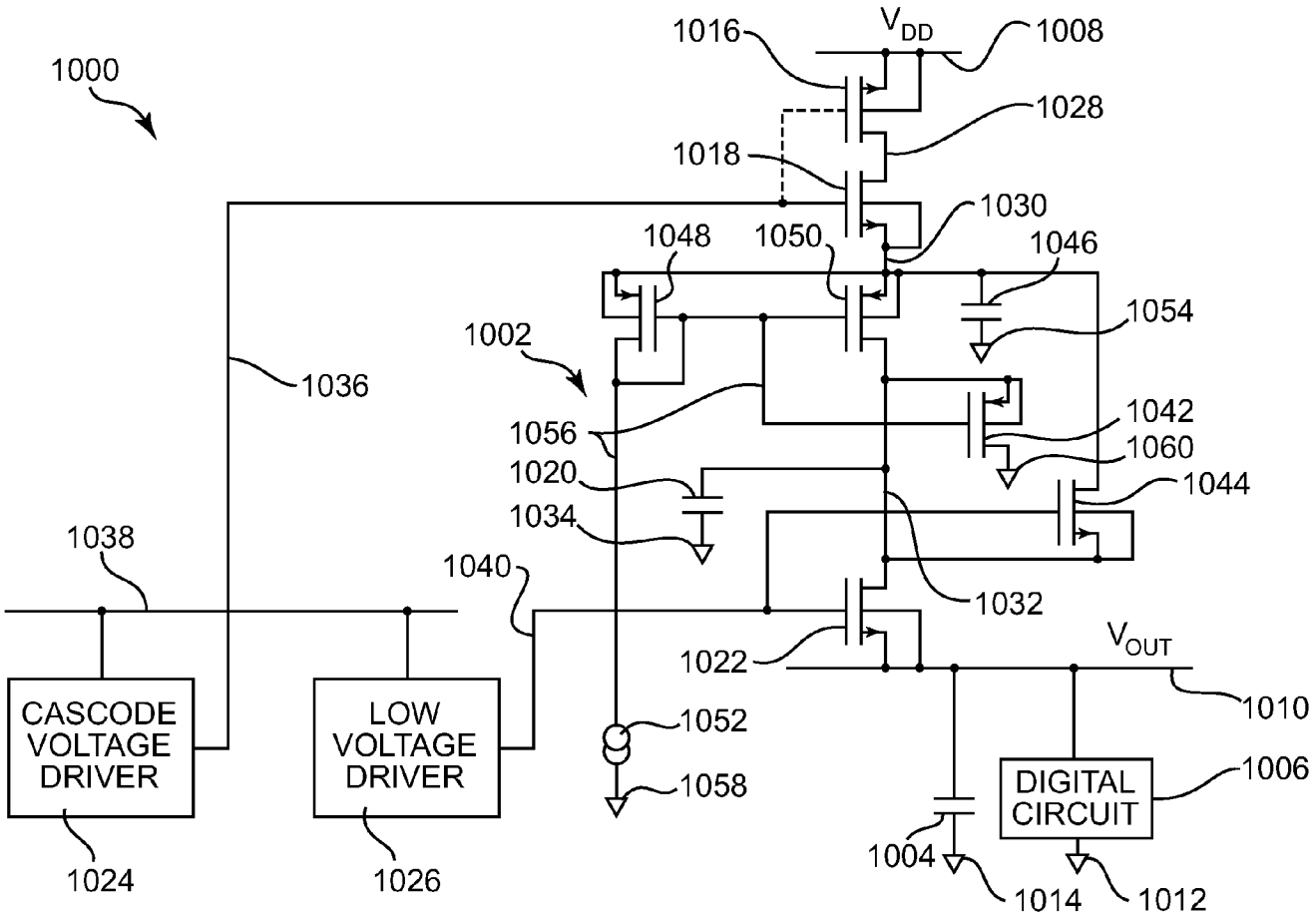
FIG. 15 is a diagram illustrating one embodiment of a LDO voltage regulator that provides a substantially constant current via a current source damping device.

FIG. 15 is a diagram illustrating one embodiment of a LDO voltage regulator 1000 that provides underload current and shunts away overload current to provide a substantially constant current via a current source damping device 1002. LDO voltage regulator 1000 is coupled to a load capacitance 1004 and a digital circuit 1006. LDO voltage regulator 1000 receives power supply voltage VDD at 1008 and provides regulated output voltage VOUT at 1010. LDO voltage regulator 1000 is similar to voltage regulator 22 (shown in FIG. 1).

Digital circuit 1006 and one end of load capacitance 1004 are electrically coupled to the output of LDO voltage regulator 1000 via output line 1010. Digital circuit 1006 is electrically coupled to a circuit reference, such as ground, at 1012, and the other end of load capacitance 1004 is electrically coupled to a circuit reference, such as ground, at 1014. Load capacitance 1004 is substantially determined by the connected load. Digital circuit 1006 generates current spikes, such as switching current spikes and current spikes due to pre-loading and un-loading of capacitances.

LDO voltage regulator 1000 includes a protection transistor 1016, a cascode transistor 1018, current source 1002, tank capacitor 1020, a regulation transistor 1022, a cascode voltage driver 1024 and a low voltage driver 1026. Protection transistor 1016 is an NMOS transistor having its body and source electrically coupled to power supply voltage VDD at 1008. The drain of protection transistor 1016 is electrically coupled to the drain of cascode transistor 1018 via current path 1028. Cascode transistor 1018 is a high voltage NMOS transistor having its body and source electrically coupled to current source 1002 via current path 1030. Current source 1002 is electrically coupled to the drain of regulation transistor 1022 and one end of tank capacitor 1020 via current path 1032. Regulation transistor 1022 is a low voltage NMOS transistor in a source follower configuration having its body and source electrically coupled to load capacitance 1004 and digital circuit 1006 via output line 1010. The other end of tank capacitor 1020 is electrically coupled to a circuit reference, such as ground, at 1034.

Cascode voltage driver 1024 is electrically coupled to the gate of cascode transistor 1018 and, optionally, to the gate of protection transistor 1016 via control input path 1036. The gate of cascode transistor 1018 is a control input driven by cascode voltage driver 1024. Cascode voltage driver 1024 is electrically coupled to a voltage source at 1038 to receive a regulated voltage at 1038 and provide a drive voltage to the gate of cascode transistor 1018 and protection transistor 1016 via control input path 1036. Protection transistor 1016 is a reverse battery or power supply protection circuit. In one embodiment, cascode voltage driver 1024 is electrically coupled at 1038 to the output of LDO voltage regulator 1000 via output line 1010. In one embodiment, cascode voltage driver 1024 is similar to the circuit that drives cascode transistor 202 (shown in FIG. 4) including switching circuit 224, cascode compensation circuit 226 and cascode compensation capacitor 228. In one embodiment, cascode voltage driver 1024 is similar to cascode voltage driver 822 of FIG. 12.

Low voltage driver 1026 is electrically coupled to the gate of regulation transistor 1022 via control input path 1040 and to the voltage source at 1038. The gate of regulation transistor 1022 is a control input driven by low voltage driver 1026. Low voltage driver 1026 receives regulated voltage at 1038 and provides a driver voltage to the gate of regulation transistor 1022 via control input path 1040. In one embodiment, low voltage driver 1026 is electrically coupled at 1038 to the output of LDO voltage regulator 1000 via output line 1010. In one embodiment, low voltage driver 1026 is separately electrically coupled to the voltage source at 1038 and to the output at 1010 of LDO voltage regulator 1000. In one embodiment, low voltage driver 1026 is similar to low voltage driver 112 (shown in FIG. 2). In one embodiment, low voltage driver 1026 is similar to low voltage driver 214 (shown in FIG. 4). In one embodiment, low voltage driver 1026 is similar to the circuit that drives regulation transistor 314 (shown in FIG. 6). In one embodiment, low voltage driver 1026 is similar to low voltage driver 520 (shown in FIG. 8). In one embodiment, low voltage driver 1026 is similar to low voltage driver 620 (shown in FIG. 9). In one embodiment, low voltage driver 1026 is similar to low voltage driver 824 of FIG. 13.

LDO voltage regulator 1000 includes current source 1002, a PMOS overload transistor 1042, an NMOS underload transistor 1044 and a filter capacitor 1046. Current source 1002 includes a current mirror pair of PMOS transistors 1048 and 1050 and a current source 1052. The body and source of cascode transistor 1018 are electrically coupled to the body and source of each of the PMOS transistors 1048 and 1050, and to one end of filter capacitor 1046 and to the drain of underload transistor 1044 via current path 1030. The other end of filter capacitor 1046 is electrically coupled to a circuit reference, such as ground, at 1054.

The gates of PMOS transistors 1048 and 1050 are electrically coupled together and to the drain of PMOS transistor 1048, and to one end of current source 1052 and to the gate of overload transistor 1042 via current source path 1056. The other end of current source 1052 is electrically coupled to a circuit reference, such as ground, at 1058. The drain of PMOS transistor 1050 is electrically coupled to the drain of regulation transistor 1022, and to one end of tank capacitor 1020, and to the body and source of overload transistor 1042, and to the body and source of underload transistor 1044 via current path 1032. Low voltage driver 1026 is electrically coupled to the gate of regulation transistor 1022 and to the gate of underload transistor 1044 via control input path 1040. The drain of overload transistor 1042 is electrically coupled to a circuit reference, such as ground, at 1060. In other embodiments, current source 1002 is a regulated current source.

In operation, digital circuit 1006 generates current spikes and LDO voltage regulator 1000 responds by providing current to digital circuit 1006. Regulation transistor 1022 is biased to conduct via low voltage driver 1026 to provide current for the current spikes, where the current is at least partially drawn from tank capacitor 1020. In the process, tank capacitor 1020 discharges and current source 1002 provides current to recharge tank capacitor 1020. Protection transistor 1016 and cascode transistor 1018 are biased to conduct via cascode voltage driver 1024. The current mirror pair of PMOS transistors 1048 and 1050 receive current from the power supply at 1008 via protection transistor 1016 and cascode transistor 1018 and PMOS transistor 1050 provides current to tank capacitor 1020 and regulation transistor 1032.

If current source 1002 overloads tank capacitor 1020, overload transistor 1042 is biased to conduct and shunt current away from tank capacitor 1020 and regulation transistor 1022. This maintains a substantially constant current flow from PMOS transistor 1050. If current source 1002 underloads tank capacitor 1020, underload transistor 1044 is biased to conduct to provide current from cascode transistor 1018 to tank capacitor 1020 and regulation transistor 1022. Also, current flow from PMOS transistor 1050 remains substantially constant. Filter capacitor 1046 absorbs current peaks from the conducting underload transistor 1044. Filling current needs via tank capacitor 1020 and maintaining a substantially constant current from current source 1002 reduces current spiking on the power supply line at 1008, which reduces EMI.

Figure 16:
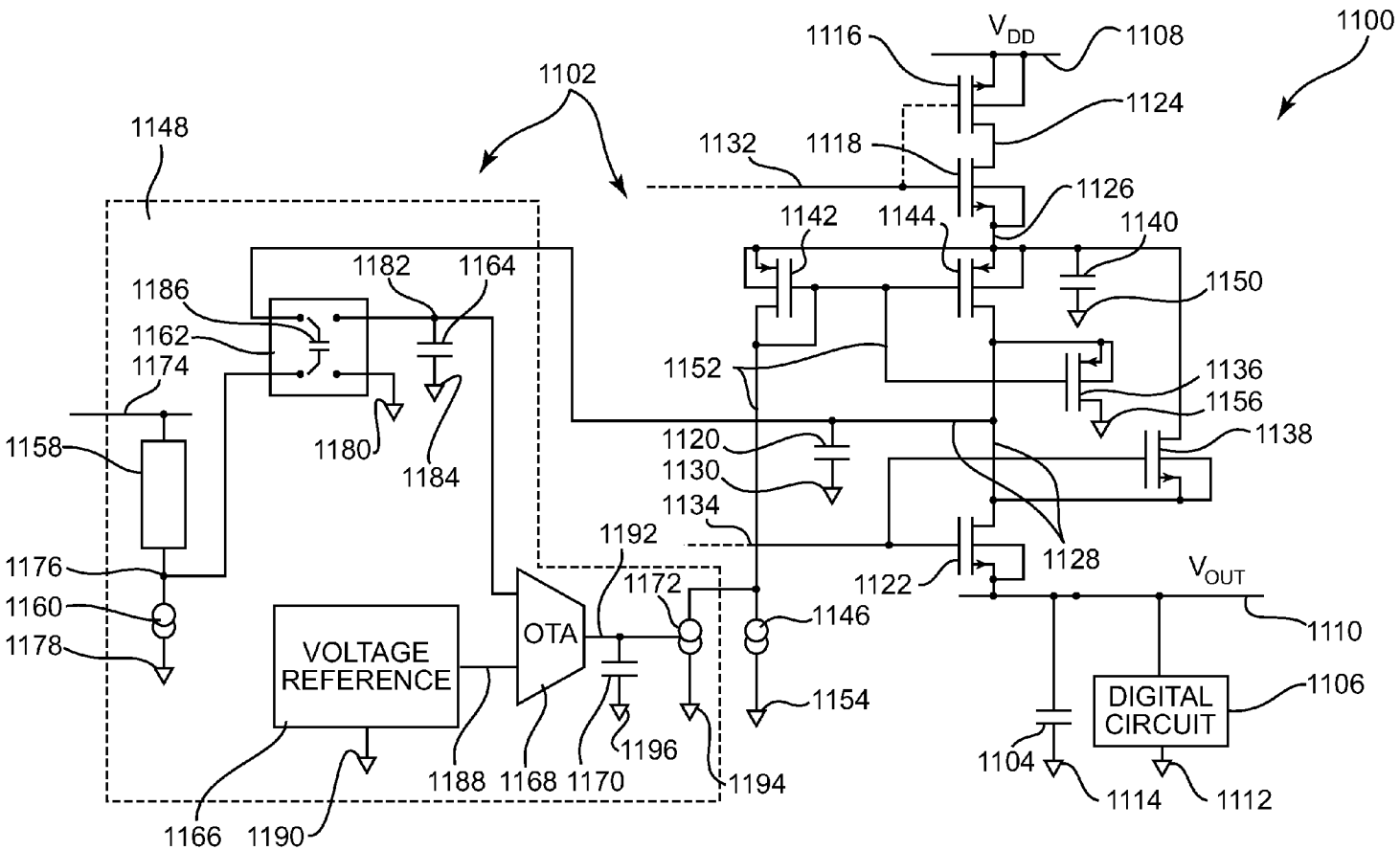
FIG. 16 is a diagram illustrating one embodiment of a LDO voltage regulator including a regulated current source.

FIG. 16 is a diagram illustrating one embodiment of a LDO voltage regulator 1100 including a regulated current source 1102. LDO voltage regulator 1100 is coupled to a load capacitance 1104 and a digital circuit 1106. LDO voltage regulator 1100 receives power supply voltage VDD at 1108 and provides regulated output voltage VOUT at 1110. LDO voltage regulator 1100 is similar to voltage regulator 22 (shown in FIG. 1).

Digital circuit 1106 and one end of load capacitance 1104 are electrically coupled to the output of LDO voltage regulator 1100 via output line 1110. Digital circuit 1106 is electrically coupled to a circuit reference, such as ground, at 1112, and the other end of load capacitance 1104 is electrically coupled to a circuit reference, such as ground, at 1114. Load capacitance 1104 is substantially determined by the connected load. Digital circuit 1106 generates current spikes, such as switching current spikes and current spikes due to pre-loading and un-loading of capacitances.

LDO voltage regulator 1100 includes a protection transistor 1116, a cascode transistor 1118, regulated current source 1102, tank capacitor 1120, and a regulation transistor 1122. Protection transistor 1116 is an NMOS transistor having its body and source electrically coupled to power supply voltage VDD at 1108. The drain of protection transistor 1116 is electrically coupled to the drain of cascode transistor 1118 via current path 1124. Cascode transistor 1118 is a high voltage NMOS transistor having its body and source electrically coupled to current source 1102 via current path 1126. Current source 1102 is electrically coupled to the drain of regulation transistor 1122 and one end of tank capacitor 1120 via current path 1128. Regulation transistor 1122 is a low voltage NMOS transistor in a source follower configuration having its body and source electrically coupled to load capacitance 1104 and digital circuit 1106 via output line 1110. The other end of tank capacitor 1120 is electrically coupled to a circuit reference, such as ground, at 1130.

The gate of cascode transistor 1118 and, optionally, the gate of protection transistor 1116 are electrically coupled to a cascode voltage driver (not shown) via control input path 1132. The gate of cascode transistor 1118 is a control input driven by the cascode voltage driver. Protection transistor 1116 is a reverse battery or power supply protection circuit. In one embodiment, the cascode voltage driver (not shown) is similar to cascode voltage driver 1024 (shown in FIG. 15).

The gate of regulation transistor 1122 is electrically coupled to a low voltage driver (not shown) via control input path 1134. The gate of regulation transistor 1122 is a control input driven by the low voltage driver. In one embodiment, the low voltage driver (not shown) is similar to low voltage driver 1026 (shown in FIG. 15).

LDO voltage regulator 1100 includes regulated current source 1102, a PMOS overload transistor 1136, an NMOS underload transistor 1138 and a filter capacitor 1140. Regulated current source 1102 includes a current mirror pair of PMOS transistors 1142 and 1144, a constant current source 1146 and a current regulation circuit 1148.

The body and source of cascode transistor 1118 are electrically coupled to the body and source of each of the PMOS transistors 1142 and 1144, and to one end of filter capacitor 1140 and to the drain of underload transistor 1138 via current path 1126. The other end of filter capacitor 1140 is electrically coupled to a circuit reference, such as ground, at 1150.

The gates of PMOS transistors 1142 and 1144 are electrically coupled together and to the drain of PMOS transistor 1142, and to one end of current source 1146 and to the gate of overload transistor 1136 via current source path 1152. The other end of current source 1146 is electrically coupled to a circuit reference, such as ground, at 1154. The drain of PMOS transistor 1144 is electrically coupled to the drain of regulation transistor 1122, and to one end of tank capacitor 1120, and to the body and source of overload transistor 1136, and to the body and source of underload transistor 1138 via current path 1128. The gate of regulation transistor 1122 is electrically coupled to the gate of underload transistor 1138 and to the low voltage driver via control input path 1134. The drain of overload transistor 1136 is electrically coupled to a circuit reference, such as ground, at 1156.

Current regulation circuit 1148 includes a resistor 1158, a current source 1160, a switching circuit 1162, a first capacitor 1164, a voltage reference 1166, an OTA 1168, a second capacitor 1170 and a regulated current source 1172. One end of resistor 1158 receives a regulated voltage at 1174 and the other end is electrically coupled to one end of current source 1160 and one input of switching circuit 1162 via input path 1176. The other end of current source 1160 is electrically coupled to a circuit reference, such as ground, at 1178. Current flows through resistor 1158 and current source 1160 to provide a reference voltage at 1176 to the input of switching circuit 1162. The other input of switching circuit 1162 is electrically coupled to one end of tank capacitor 1120 via current path 1128.

One output of switching circuit 1162 is electrically coupled to a circuit reference, such as ground, at 1180 and the other output of switching circuit 1162 is electrically coupled to one end of first capacitor 1164 and one input of OTA 1168 via OTA input path 1182. The other end of first capacitor 1164 is electrically coupled to a circuit reference, such as ground, at 1184.

Switching circuit 1162 includes a switched capacitor 1186 that is switched between the switching circuit inputs and the switching circuit outputs. Switched capacitor 1186 receives the voltage difference between tank capacitor 1120 and the reference voltage at 1176. This voltage is output to the input of OTA 1168. The other input of OTA 1168 is electrically coupled to voltage reference 1166 via input path 1188 and receives a voltage reference value. Voltage reference 1166 is electrically coupled to a circuit reference, such as ground, at 1190. In one embodiment, switching circuit 1162 operates at greater than 100 kHz. In one embodiment, switching circuit 1162 operates at greater than 1 MHz.

At one input OTA 1168 receives the voltage difference between the voltage on tank capacitor 1120 and the reference voltage at 1176 and on the other input OTA 1168 receives the reference voltage value at 1188. The output of OTA 1168 is electrically coupled to one end of second capacitor 1170 and the control input of regulated current source 1172 via output path 1192. OTA 1168 provides an output voltage at 1192 that corresponds to the input voltages.

The control input of regulated current source 1172 receives the output voltage at 1192 and provides a corresponding current. One end of regulated current source 1172 is electrically coupled to the drain and gate of PMOS transistor 1142 and to constant current source 1146 via current source path 1152 and the other end of regulated current source 1172 is electrically coupled to a circuit reference, such as ground, at 1194. Also, the other end of second capacitor 1170 is electrically coupled to a circuit reference, such as ground, at 1196.

Switching circuit 1162 captures the difference between the voltage on tank capacitor 1120 and the reference voltage at 1176 on switched capacitor 1186. This voltage is switched to the input of OTA 1168 and compared to the reference voltage at 1188. If the voltage on tank capacitor 1120 is low, OTA 1168 provides an output voltage at 1192 that increases the current through regulated current source 1172, which increases charge current to tank capacitor 1120 via PMOS transistor 1144. If the voltage on tank capacitor 1120 is high, OTA 1168 provides an output voltage at 1192 to decrease current through regulated current source 1172, which decreases charge current to tank capacitor 1120 via PMOS transistor 1144.

In operation, digital circuit 1106 generates current spikes and LDO voltage regulator 1100 responds by providing current to digital circuit 1106. Regulation transistor 1122 is biased to conduct via the low voltage driver (not shown) to provide current for the current spikes, where the current is at least partially drawn from tank capacitor 1120. In the process, tank capacitor 1120 discharges and current source 1102 provides current to recharge tank capacitor 1120.

Protection transistor 1116 and cascode transistor 1118 are biased to conduct via the cascode voltage driver (not shown). The current mirror pair of PMOS transistors 1142 and 1144 receives current from the power supply at 1108 via protection transistor 1116 and cascode transistor 1118 and PMOS transistor 1144 provides current to tank capacitor 1120 and regulation transistor 1122. This charge current is regulated via OTA 1168 and regulated current source 1172 based on the voltage on tank capacitor 1120.

If current source 1102 overloads tank capacitor 1120, overload transistor 1136 is biased to conduct and shunt current away from tank capacitor 1120 and regulation transistor 1122. If current source 1102 underloads tank capacitor 1120, underload transistor 1138 is biased to conduct to provide current from cascode transistor 1118 to tank capacitor 1120 and regulation transistor 1122. Filter capacitor 1140 absorbs current peaks from the conducting underload transistor 1138. Filling current needs via tank capacitor 1120 reduces current spiking on the power supply line at 1008, which reduces EMI.

Figure 17:
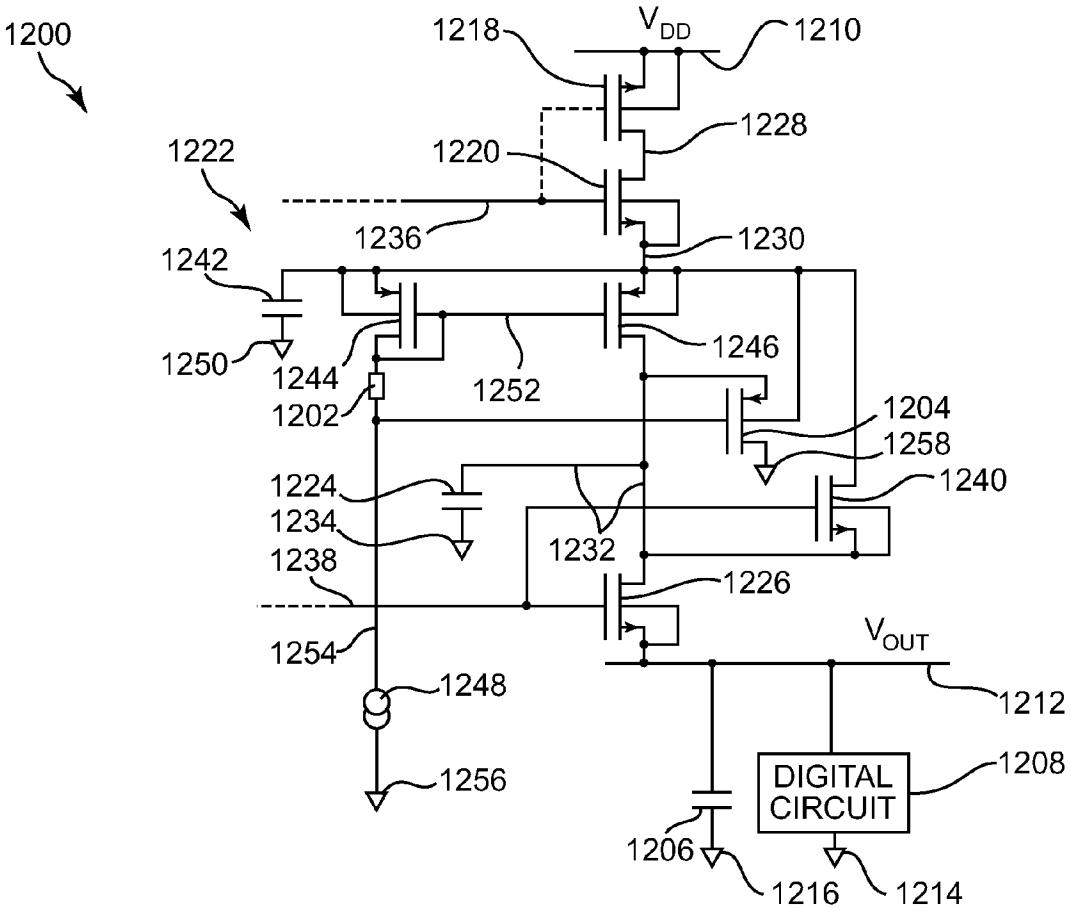
FIG. 17 is a diagram illustrating one embodiment of a LDO voltage regulator including a resistor in a current mirror path for driving an overload transistor.

FIG. 17 is a diagram illustrating one embodiment of a LDO voltage regulator 1200 including a resistor 1202 in a current mirror path for driving an overload transistor 1204. LDO voltage regulator 1200 is coupled to load capacitance 1206 and a digital circuit 1208. LDO voltage regulator 1200 receives power supply voltage VDD at 1210 and provides regulated output voltage VOUT at 1212. LDO voltage regulator 1200 is similar to voltage regulator 22 (shown in FIG. 1).

Digital circuit 1208 and one end of load capacitance 1206 are electrically coupled to the output of LDO voltage regulator 1200 via output line 1212. Digital circuit 1208 is electrically coupled to a circuit reference, such as ground, at 1214, and the other end of load capacitance 1206 is electrically coupled to a circuit reference, such as ground, at 1216. Load capacitance 1206 is substantially determined by the connected load. Digital circuit 1208 generates current spikes, such as switching current spikes and current spikes due to pre-loading and un-loading of capacitances.

LDO voltage regulator 1200 includes a protection transistor 1218, a cascode transistor 1220, a current source 1222, a tank capacitor 1224 and a regulation transistor 1226. Protection transistor 1218 is an NMOS transistor having its body and source electrically coupled to power supply voltage VDD at 1210. The drain of protection transistor 1218 is electrically coupled to the drain of cascode transistor 1220 via current path 1228. Cascode transistor 1220 is a high voltage NMOS transistor having its body and source electrically coupled to current source 1222 via current path 1230. Current source 1222 is electrically coupled to the drain of regulation transistor 1226 and one end of tank capacitor 1224 via current path 1232. Regulation transistor 1226 is a low voltage NMOS transistor in a source follower configuration having its body and source electrically coupled to load capacitance 1206 and digital circuit 1208 via output line 1212. The other end of tank capacitor 1224 is electrically coupled to a circuit reference, such as ground, at 1234.

The gate of cascode transistor 1220 and, optionally, the gate of protection transistor 1218 are electrically coupled to a cascode voltage driver (not shown) via control input path 1236. The gate of cascode transistor 1220 is a control input driven by the cascode voltage driver. Protection transistor 1218 is a reverse battery or power supply protection circuit. In one embodiment, the cascode voltage driver (not shown) is similar to cascode voltage driver 1024 (shown in FIG. 15).

The gate of regulation transistor 1226 is electrically coupled to a low voltage driver (not shown) via control input path 1238. The gate of regulation transistor 1226 is a control input driven by the low voltage driver. In one embodiment, the low voltage driver (not shown) is similar to low voltage driver 1026 (shown in FIG. 15).

LDO voltage regulator 1200 includes current source 1222, the PMOS overload transistor 1204, an NMOS underload transistor 1240 and a filter capacitor 1242. Current source 1222 includes a current mirror pair of PMOS transistors 1244 and 1246 and a current source 1248. The body and source of cascode transistor 1220 are electrically coupled to the body and source of each of the PMOS transistors 1244 and 1246, to one end of filter capacitor 1242, to the body of overload transistor 1204 and to the drain of underload transistor 1240 via current path 1230. The other end of filter capacitor 1242 is electrically coupled to a circuit reference, such as ground, at 1250.

The gates of PMOS transistors 1244 and 1246 are electrically coupled together and to the drain of PMOS transistor 1244 and to one end of resistor 1202 via current source path 1252. The other end of resistor 1202 is electrically coupled to current source 1248 and the gate of overload transistor 1204 via current source path 1254. The other end of current source 1248 is electrically coupled to a circuit reference, such as ground, at 1256. The drain of PMOS transistor 1246 is electrically coupled to the drain of regulation transistor 1226, to one end of tank capacitor 1224, to the source of overload transistor 1204 and to the body and source of underload transistor 1240 via current path 1232. The gate of regulation transistor 1226 and the gate of underload transistor 1240 is electrically coupled to the low voltage driver (not shown) via control input path 1238. The drain of overload transistor 1204 is electrically coupled to a circuit reference, such as ground, at 1258.

In operation, digital circuit 1208 generates current spikes and LDO voltage regulator 1200 responds by providing current to digital circuit 1208. Regulation transistor 1226 is biased to conduct via the low voltage driver (not shown) to provide current for the current spikes, where the current is at least partially drawn from tank capacitor 1224. In the process, tank capacitor 1224 discharges and current source 1222 provides current to recharge tank capacitor 1224.

Protection transistor 1218 and cascode transistor 1220 are biased to conduct via the cascode voltage driver (not shown). The current mirror pair of PMOS transistors 1244 and 1246 receives current from the power supply at 1210 via protection transistor 1218 and cascode transistor 1220. PMOS transistor 1246 provides current to tank capacitor 1224 and regulation transistor 1226.

If current source 1222 overloads tank capacitor 1224, the voltage on the source of overload transistor 1204 and the voltage on the gate of overload transistor 1204 bias overload transistor 1204 to conduct and shunt current away from tank capacitor 1224 and regulation transistor 1226. This maintains a substantially constant current flow from PMOS transistor 1246. If current source 1222 underloads tank capacitor 1224, the voltage on the source of underload transistor 1240 drops and underload transistor 1240 is biased to conduct to provide current from cascode transistor 1220 to tank capacitor 1224 and regulation transistor 1226, where current flow from PMOS transistor 1246 remains substantially constant. Filter capacitor 1242 absorbs current peaks from the conducting underload transistor 1240. Filling current needs via tank capacitor 1224 and maintaining a substantially constant current from current source 1222 reduces current spiking on the power supply line at 1210, which reduces EMI.

Figure 18:
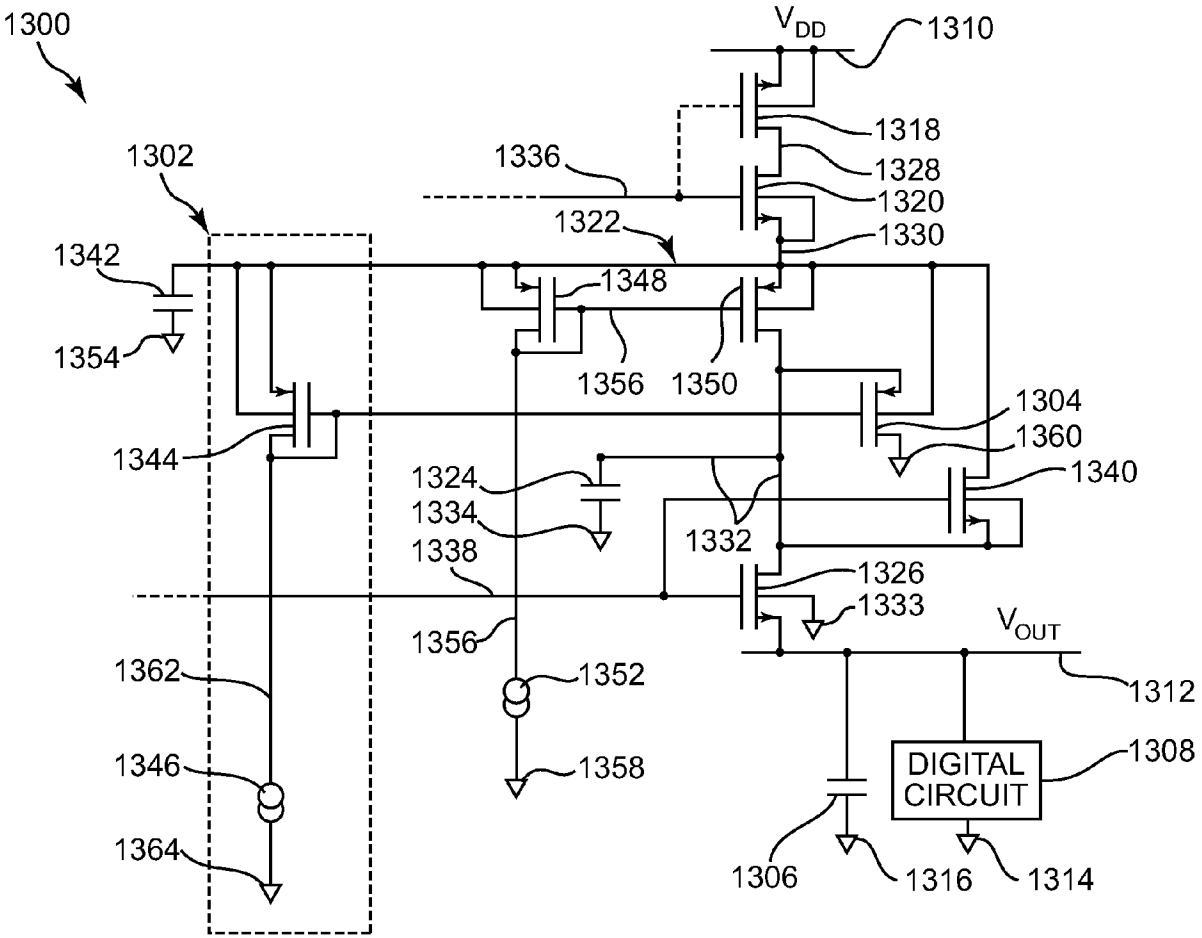
FIG. 18 is a diagram illustrating one embodiment of a LDO voltage regulator including a gate drive circuit for driving an overload transistor.

FIG. 18 is a diagram illustrating one embodiment of a LDO voltage regulator 1300 including a gate drive circuit 1302 for driving overload transistor 1304. LDO voltage regulator 1300 is coupled to load capacitance 1306 and a digital circuit 1308. LDO voltage regulator 1300 receives power supply voltage VDD at 1310 and provides regulated output voltage VOUT at 1312. LDO voltage regulator 1300 is similar to voltage regulator 22 (shown in FIG. 1).

Digital circuit 1308 and one end of load capacitance 1306 are electrically coupled to the output of LDO voltage regulator 1300 via output line 1312. Digital circuit 1308 is electrically coupled to a circuit reference, such as ground, at 1314, and the other end of load capacitance 1306 is electrically coupled to a circuit reference, such as ground, at 1316. Load capacitance 1306 is substantially determined by the connected load. Digital circuit 1308 generates current spikes, such as switching current spikes and current spikes due to pre-loading and un-loading of capacitances.

LDO voltage regulator 1300 includes a protection transistor 1318, a cascode transistor 1320, a current source 1322, a tank capacitor 1324 and a regulation transistor 1326. Protection transistor 1318 is an NMOS transistor having its body and source electrically coupled to power supply voltage VDD at 1310. The drain of protection transistor 1318 is electrically coupled to the drain of cascode transistor 1320 via current path 1328. Cascode transistor 1320 is a high voltage NMOS transistor having its body and source electrically coupled to current source 1322 via current path 1330. Current source 1322 is electrically coupled to the drain of regulation transistor 1326 and one end of tank capacitor 1324 via current path 1332. Regulation transistor 1326 is a low voltage NMOS transistor in a source follower configuration having its source electrically coupled to load capacitance 1306 and digital circuit 1308 via output line 1312 and its body electrically coupled to a circuit reference, such as ground, at 1333. The other end of tank capacitor 1324 is electrically coupled to a circuit reference, such as ground, at 1334.

The gate of cascode transistor 1320 and, optionally, the gate of protection transistor 1318 are electrically coupled to a cascode voltage driver (not shown) via control input path 1336. The gate of cascode transistor 1320 is a control input driven by the cascode voltage driver. Protection transistor 1318 is a reverse battery or power supply protection circuit. In one embodiment, the cascode voltage driver (not shown) is similar to cascode voltage driver 1024 (shown in FIG. 15).

The gate of regulation transistor 1326 is electrically coupled to a low voltage driver (not shown) via control input path 1338. The gate of regulation transistor 1326 is a control input driven by the low voltage driver. In one embodiment, the low voltage driver (not shown) is similar to low voltage driver 1026 (shown in FIG. 15).

LDO voltage regulator 1300 includes current source 1322, gate drive circuit 1302, PMOS overload transistor 1304, NMOS underload transistor 1340 and filter capacitor 1342. Gate drive circuit 1302 includes PMOS transistor 1344 and first current source 1346. Current source 1322 includes a current mirror pair of PMOS transistors 1348 and 1350 and a second current source 1352. The body and source of cascode transistor 1320 are electrically coupled to the body and source of PMOS transistor 1344, the body and source of each of the PMOS transistors 1348 and 1350, one end of filter capacitor 1342, to the body of overload transistor 1304 and to the drain of underload transistor 1340 via current path 1330. The other end of filter capacitor 1342 is electrically coupled to a circuit reference, such as ground, at 1354.

The gates of PMOS transistors 1348 and 1350 are electrically coupled together and to the drain of PMOS transistor 1348 and to current source 1352 via current source path 1356. The other end of current source 1352 is electrically coupled to a circuit reference, such as ground, at 1358. The drain of PMOS transistor 1350 is electrically coupled to the drain of regulation transistor 1326, to one end of tank capacitor 1324, to the source of overload transistor 1304 and to the body and source of underload transistor 1340 via current path 1332. The gate of regulation transistor 1326 and the gate of underload transistor 1340 are electrically coupled to the low voltage driver (not shown) via control input path 1338. The drain of overload transistor 1304 is electrically coupled to a circuit reference, such as ground, at 1360.

The gate of overload transistor 1304 is electrically coupled to the gate and drain of PMOS transistor 1344 and to first current source 1346 via gate drive path 1362. The other side of first current source 1346 is electrically coupled to a circuit reference, such as ground, at 1364. PMOS transistor 1344 is biased to conduct via first current source 1346 and provides a gate voltage at 1362 to the gate of overload transistor 1304.

In operation, digital circuit 1308 generates current spikes and LDO voltage regulator 1300 responds by providing current to digital circuit 1308. Regulation transistor 1326 is biased to conduct via the low voltage driver (not shown) to provide current for the current spikes, where the current is at least partially drawn from tank capacitor 1324. In the process, tank capacitor 1324 discharges and current source 1322 provides current to recharge tank capacitor 1324.

Protection transistor 1318 and cascode transistor 1320 are biased to conduct via the cascode voltage driver (not shown). The current mirror pair of PMOS transistors 1348 and 1350 receives current from the power supply at 1310 via protection transistor 1318 and cascode transistor 1320. PMOS transistor 1350 provides current to tank capacitor 1324 and regulation transistor 1326.

If current source 1322 overloads tank capacitor 1324, the voltage on the source of overload transistor 1304 and the voltage at 1362 on the gate of overload transistor 1304 bias overload transistor 1304 to conduct and shunt current away from tank capacitor 1324 and regulation transistor 1326. This maintains a substantially constant current flow from PMOS transistor 1350. If current source 1322 underloads tank capacitor 1324, the voltage on the source of underload transistor 1340 drops and underload transistor 1340 is biased to conduct to provide current from cascode transistor 1320 to tank capacitor 1324 and regulation transistor 1326, where current flow from PMOS transistor 1350 remains substantially constant. Filter capacitor 1342 absorbs current peaks from the conducting underload transistor 1340. Filling current needs via tank capacitor 1324 and maintaining a substantially constant current from current source 1322 reduces current spiking on the power supply line at 1310, which reduces EMI.

Figure 19:
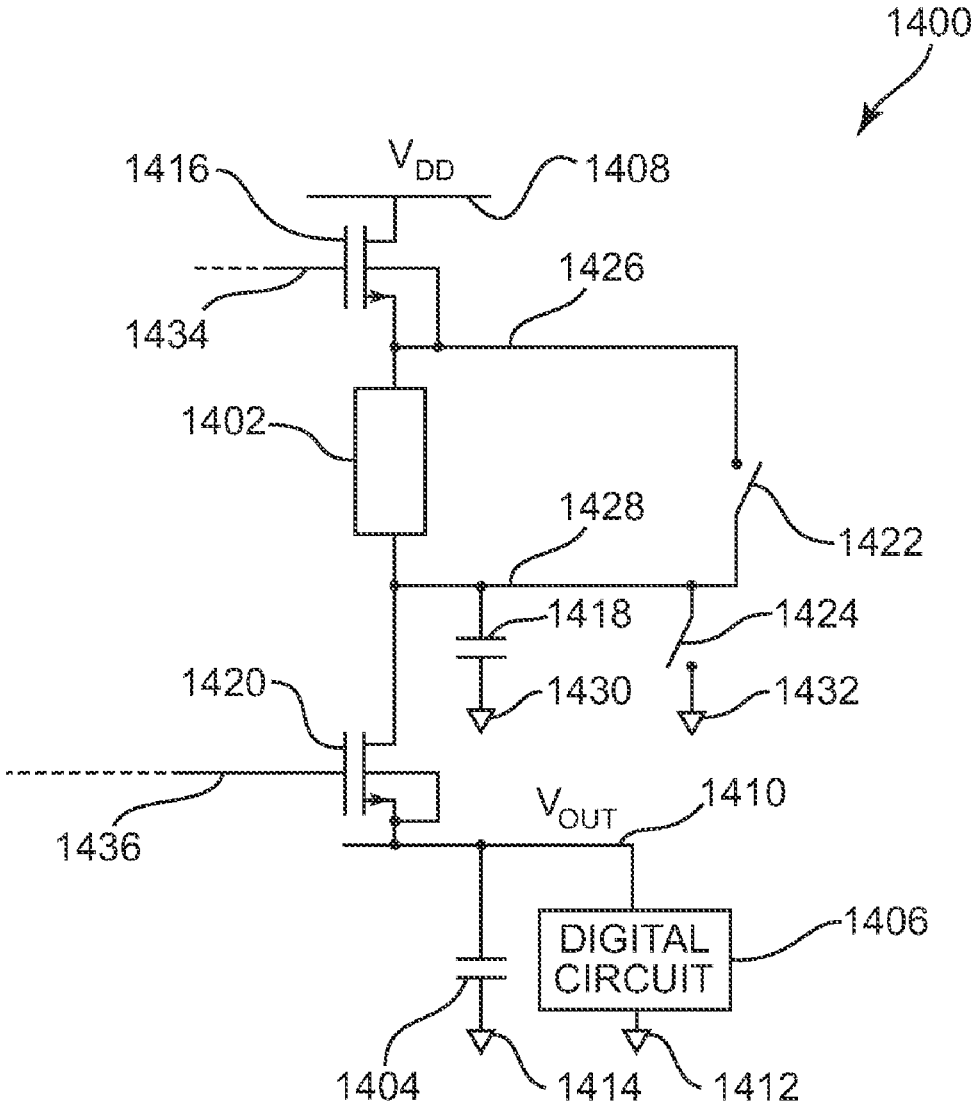
FIG. 19 is a diagram illustrating a LDO voltage regulator including a resistor as a damping device.

FIG. 19 is a diagram illustrating a LDO voltage regulator 1400 including a resistor 1402 as a damping device. LDO voltage regulator 1400 provides underload current and shunts away overload current to provide a substantially constant charging current. LDO voltage regulator 1400 is coupled to a load capacitance 1404 and a digital circuit 1406. LDO voltage regulator 1400 receives power supply voltage VDD at 1408 and provides regulated output voltage VOUT at 1410. LDO voltage regulator 1400 is similar to voltage regulator 22 (shown in FIG. 1).

Digital circuit 1406 and one end of load capacitance 1404 are electrically coupled to the output of LDO voltage regulator 1400 via output line 1410. Digital circuit 1406 is electrically coupled to a circuit reference, such as ground, at 1412, and the other end of load capacitance 1404 is electrically coupled to a circuit reference, such as ground, at 1414. Load capacitance 1404 is substantially determined by the connected load. Digital circuit 1406 generates current spikes, such as switching current spikes and current spikes due to pre-loading and un-loading of capacitances.

LDO voltage regulator 1400 includes a cascode transistor 1416, resistor 1402, a tank capacitor 1418, a regulation transistor 1420, underload switch 1422 and an overload switch 1424. Cascode transistor 1416 is a high voltage NMOS transistor. The drain of cascode transistor 1416 is electrically coupled to power supply voltage VDD at 1408 and the body and source of cascode transistor 1416 are electrically coupled to one end of resistor 1402 and underload switch 1422 via current path 1426. The other end of resistor 1402 is electrically coupled to the drain of regulation transistor 1420, one end of tank capacitor 1418, the other side of underload switch 1422 and one side of overload switch 1424 via current path 1428. Regulation transistor 1420 is a low voltage NMOS transistor in a source follower configuration. The body and source of regulation transistor 1420 are electrically coupled to load capacitance 1404 and digital circuit 1406 via output line 1410. The other end of tank capacitor 1418 is electrically coupled to a circuit reference, such as ground, at 1430, and the other side of overload switch 1424 is electrically coupled to a circuit reference, such as ground, at 1432.

The gate of cascode transistor 1416 is electrically coupled to a cascode voltage driver (not shown) via control input path 1434. The gate of cascode transistor 1416 is a control input driven by the cascode voltage driver. In one embodiment, the cascode voltage driver (not shown) is similar to cascode voltage driver 1024 (shown in FIG. 15).

The gate of regulation transistor 1420 is electrically coupled to a low voltage driver (not shown) via control input path 1436. The gate of regulation transistor 1420 is a control input driven by the low voltage driver. In one embodiment, the low voltage driver (not shown) is similar to low voltage driver 1026 (shown in FIG. 15).

In operation, digital circuit 1406 generates current spikes and LDO voltage regulator 1400 responds by providing current to digital circuit 1406. Regulation transistor 1420 is biased on to provide current for the current spikes, where the current is at least partially drawn from tank capacitor 1418. In the process, tank capacitor 1418 discharges and resistor 1402 provides current to recharge tank capacitor 1418. Resistor 1402 receives current from the power supply at 1408 via cascode transistor 1416 and provides current to tank capacitor 1418 and regulation transistor 1420.

If tank capacitor 1418 is overloaded, overload switch 1424 switches on to shunt current away from tank capacitor 1418 and regulation transistor 1420, which maintains a substantially constant current from resistor 1402. If tank capacitor 1418 is underloaded, underload switch 1422 switches on to provide current from cascode transistor 1416 to tank capacitor 1418 and regulation transistor 1420 and resistor 1402 provides a substantially constant current. Filling current needs via tank capacitor 1418 and maintaining a substantially constant current via resistor 1402 reduces current spiking on the power supply line at 1408, which reduces EMI.

Figure 20:
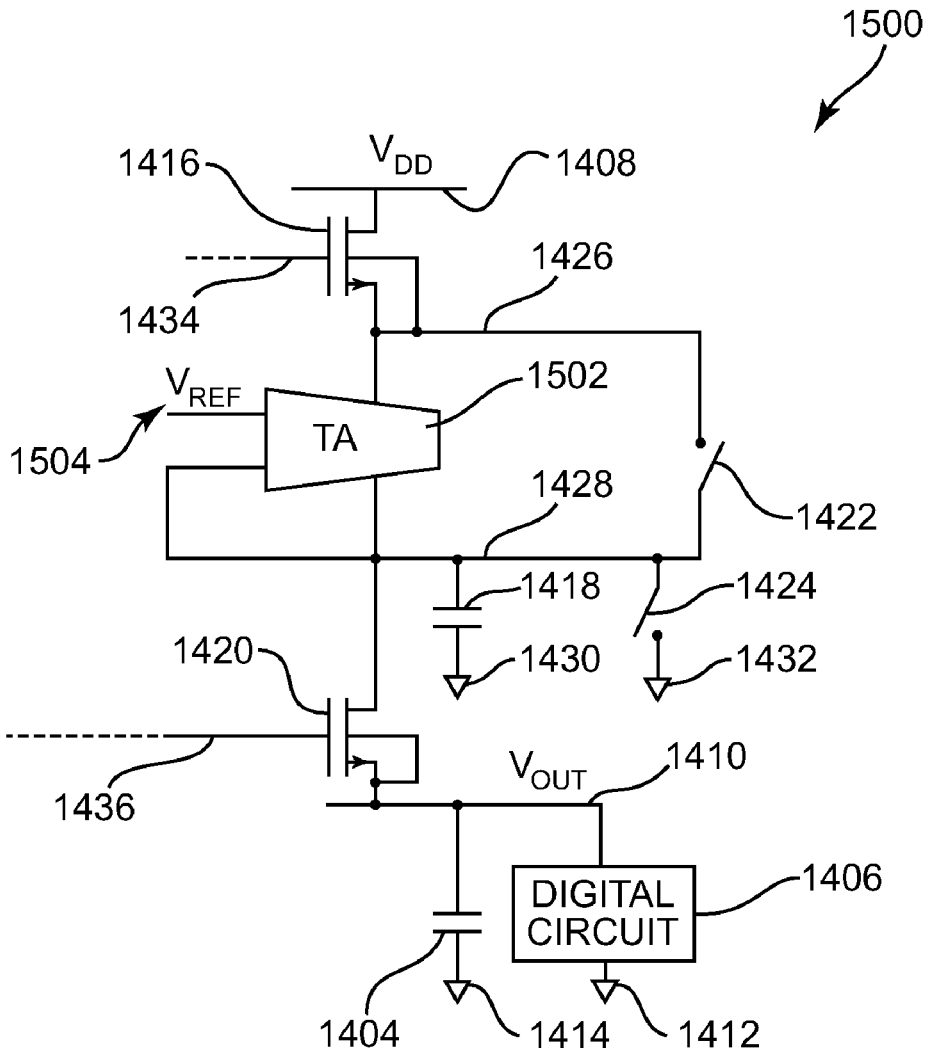
FIG. 20 is a diagram illustrating an LDO voltage regulator having a transconductance amplifier as a damping device.

FIG. 20 is a diagram illustrating an LDO voltage regulator 1500 having a transconductance amplifier 1502. LDO voltage regulator 1500 is the same as LDO voltage regulator 1400, with the exception of having resistor 1402 replaced with transconductance amplifier 1502.

The body and source of cascode transistor 1416 are electrically coupled to one side of the output of transconductance amplifier 1502 and the other side of the output of transconductance amplifier 1502 is electrically coupled to an input of the transconductance amplifier 1502, the drain of regulation transistor 1420, tank capacitor 1418, underload switch 1422 and overload switch 1424 via current path 1428. The other input of the transconductance amplifier 1502 receives a voltage reference VREF at 1504.

If the voltage on tank capacitor 1418 drops below reference voltage VREF at 1504, transconductance amplifier 1502 increases the current to tank capacitor 1418. If the voltage on tank capacitor 1418 rises above reference voltage VREF at 1504, transconductance amplifier 1502 decreases the current to tank capacitor 1418.

In operation, digital circuit 1406 generates current spikes and LDO voltage regulator 1500 responds by providing current to digital circuit 1406. Regulation transistor 1420 is biased on to provide current for the current spikes, where the current is at least partially drawn from tank capacitor 1418. In the process, tank capacitor 1418 discharges and transconductance amplifier 1502 provides current to recharge tank capacitor 1418.

If tank capacitor 1418 is overloaded, overload switch 1424 switches on to shunt current away from tank capacitor 1418 and regulation transistor 1420, which maintains a substantially constant current via transconductance amplifier 1502. If tank capacitor 1418 is underloaded, underload switch 1422 switches on to provide current from cascode transistor 1416 to tank capacitor 1418 and regulation transistor 1420 and transconductance amplifier 1502 provides a substantially constant current. Filling current needs via tank capacitor 1418 and maintaining a substantially constant current via transconductance amplifier 1502 reduces current spiking on the power supply line at 1408, which reduces EMI.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A system, comprising:

a first transistor having a first control input and configured to regulate an output voltage;

a first capacitor directly connected at one end to the first control input and directly connected at another end to a circuit reference; and a circuit configured to provide a first voltage to the first control input, wherein the circuit comprises:

a first compensation circuit configured to provide an offset voltage that is part of the first voltage and referenced to the output voltage, wherein the first compensation circuit includes a compensation transistor that is similar to the first transistor such that variations in temperature and process changes affect both the compensation transistor and the first transistor and the compensation transistor is configured to vary the offset voltage to compensate for the variations in temperature and the process changes in the first transistor.

2. The system of claim 1, wherein the circuit comprises:

an operational transconductance amplifier configured to provide a control voltage, wherein the offset voltage is added to the control voltage to provide the first voltage.

3. The system of claim 1, comprising:

a second transistor having a second control input and coupled in series with the first transistor, wherein the first transistor and the second transistor are between a power supply voltage and the output voltage.

4. The system of claim 3, wherein the first transistor is a low voltage NMOS transistor configured to be a source follower and the second transistor is a high voltage NMOS transistor.

5. The system of claim 3, comprising:

a second capacitor directly connected at one end to the second control input and directly connected at another end to the circuit reference.

6. The system of claim 3, comprising:

a second compensation circuit configured to provide a second voltage to the second control input, wherein the second compensation circuit references the second voltage to the output voltage and varies the second voltage to compensate for variations in temperature and process changes in the second transistor.

7. A system, comprising:

a first transistor having a drain/source path and configured to regulate an output voltage at an output;

a capacitor directly connected to one side of the drain/source path of the first transistor and configured to provide current to the output through the first transistor; and a device directly connected to the one side of the drain/source path of the first transistor and configured to dampen current from a power supply to provide dampened current and charge the capacitor with the dampened current, wherein the device is one of a resistor, a transconductance amplifier, and a current source including a current mirror pair of transistors.

8. The system of claim 7, wherein the first transistor is an NMOS transistor configured to be a source follower and having a drain coupled to one end of the capacitor.

9. The system of claim 7, wherein the device is the current source and the current source regulates current via voltage on the capacitor.

10. The system of claim 7, comprising:

a circuit configured to provide a voltage to a control input of the first transistor, wherein the circuit comprises:

a compensation circuit configured to provide an offset voltage and adjust the offset voltage to compensate for variations in the first transistor, wherein the offset voltage is added to another voltage to provide the voltage.

11. The system of claim 7, comprising an overload circuit configured to shunt current away from the capacitor.

12. The system of claim 7, comprising an underload circuit configured to shunt current around the device.

13. The system of claim 7, comprising:

a second transistor coupled in series with the first transistor between the power supply and the output.

14. A method for providing an output voltage comprising:

receiving a first voltage at a first control input of a first transistor;

regulating the output voltage via the first transistor;

compensating frequency responses via a capacitor directly connected at one end to the first control input and directly connected at another end to a circuit reference;

providing the first voltage to the first control input via a circuit that includes a compensation circuit;

providing an offset voltage that is part of the first voltage and referenced to the output voltage via the compensation circuit that include a compensation transistor that is similar to the first transistor such that variations in temperature and process changes affect both the compensation transistor and the first transistor; and varying the offset voltage via the compensation transistor to compensate for the variations in temperature and the process changes in the first transistor.

15. The method of claim 14, wherein providing the first voltage comprises:

providing a control voltage via an operational transconductance amplifier; and adding the offset voltage to the control voltage.

16. The method of claim 14, comprising:

receiving a second voltage at a second control input of a second transistor that is cascoded in series with the first transistor between a power supply voltage and the output voltage.

17. The method of claim 16, comprising:

providing the second voltage referenced to the output voltage; and varying the second voltage to compensate for variations in temperature and process changes in the second transistor.

18. A method for providing an output voltage at an output comprising:

regulating the output voltage via a first transistor having a drain/source path;

dampening current from a power supply via a device, which is one of a resistor, a transconductance amplifier, and a current source including a current mirror pair of transistors, directly connected to one side of the drain/source path of the first transistor to provide dampened current;

charging a capacitor directly connected to the one side of the drain/source path of the first transistor with the dampened current; and discharging the capacitor directly connected to the one side of the drain/source path of the first transistor through the first transistor to provide a current to the output.

19. The method of claim 18, comprising:

shunting at least part of the dampened current away from the capacitor.

20. The method of claim 18, comprising:

shunting at least part of the current from the power supply around the device and to the capacitor.

21. The method of claim 18, comprising:

providing a voltage to a control input of the first transistor, wherein providing the voltage comprises:

providing an offset voltage;

adjusting the offset voltage to compensate for variations in the first transistor; and adding the offset voltage to another voltage to provide the voltage.

22. The method of claim 18, comprising:

providing a voltage to a control input of a second transistor coupled in series with the first transistor between the power supply and the output.

* * * * *